US008630554B2

(12) United States Patent
Fukuta

(10) Patent No.: US 8,630,554 B2
(45) Date of Patent: Jan. 14, 2014

(54) IMAGE FORMING DEVICE

(75) Inventor: Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 362 days.

(21) Appl. No.: 13/193,209

(22) Filed: Jul. 28, 2011

(65) Prior Publication Data

US 2012/0033981 A1 Feb. 9, 2012

(30) Foreign Application Priority Data

Aug. 6, 2010 (JP) ..... 2010-178147

(51) Int. Cl.
*G03G 15/00* (2006.01)
*G03G 21/00* (2006.01)
*G03G 21/18* (2006.01)

(52) U.S. Cl.
USPC ..... 399/12; 399/13; 399/43; 399/123

(58) Field of Classification Search
USPC ..... 399/12, 13, 43, 123
See application file for complete search history.

(56) References Cited

U.S. PATENT DOCUMENTS

2003/0039495 A1* 2/2003 Takami et al. ..... 399/357
2004/0052557 A1 3/2004 Fukuta et al.
2005/0025522 A1 2/2005 Tsuzuki et al.
2006/0193646 A1 8/2006 Suzuki et al.
2009/0169258 A1 7/2009 Kamimura

FOREIGN PATENT DOCUMENTS

| | | | |
|---|---|---|---|
| JP | H05-027760 | U | 4/1993 |
| JP | 2000-035733 | A | 2/2000 |
| JP | 2004-109319 | A | 4/2004 |
| JP | 2005-055579 | A | 3/2005 |
| JP | 2006-171324 | A | 6/2006 |
| JP | 2006-267994 | A | 10/2006 |
| JP | 2006-276190 | A | 10/2006 |
| JP | 2009-157310 | A | 7/2009 |

* cited by examiner

*Primary Examiner* — David Gray
*Assistant Examiner* — Michael Harrison
(74) *Attorney, Agent, or Firm* — Baker Botts L.L.P.

(57) ABSTRACT

The image forming device includes a main body and a cartridge that is detachably mountable on the main body. The cartridge includes the image bearing member, the first and second cleaning roller, and the state changing unit. The first cleaning roller cleans the image bearing member and the second cleaning roller cleans the first cleaning roller. The state changing unit is configured to irreversibly change an electrically disconnected state between the first cleaning roller and the second cleaning roller into an electrically connected state between the first cleaning roller and the second cleaning roller. The resetting unit is configured to reset the cumulative value when the current detecting unit does not detect current before the image bearing member rotates and detects current after the image bearing member rotates.

14 Claims, 15 Drawing Sheets

| | RESULT OF CURRENT DETECTING CIRCUIT | | DETERMINATION |
|---|---|---|---|
| | BEORE ROTATION | AFTER ROTATION | |
| STATE 1 | ○ | ○ | USED CARTRIDGE |
| STATE 2 | ○ | × | ERROR |
| STATE 3 | × | ○ | NEW CARTRIDGE |
| STATE 4 | × | × | ERROR |

○:DETECTED, ×:NOT DETECTED

IMAGE FORMING DEVICE

CROSS REFERENCE TO RELATED APPLICATION

This application claims priority from Japanese Patent Application No. 2010-178147 filed Aug. 6, 2010. The entire content of the priority application is incorporated herein by reference.

TECHNICAL FIELD

The invention relates to an image forming device.

BACKGROUND

On a side surface of the conventional developer cartridge are provided a contact protrusion extending radially outward from a prescribed shaft part, a sensor gear that rotates together with the contact protrusion about the shaft part, and a plurality of gears engaged with the sensor gear that transmit a drive force to a developing roller, an agitator, and the like. When a new developer cartridge is mounted in the body of the image-forming device, the contact protrusion press against one end of a sensor actuator disposed in the device body. The pressure by the contact protrusion pivots the sensor actuator, and a sensor detects this movement, enabling the image-forming device to determine that a new developer cartridge has been mounted.

SUMMARY

As described above, the contact protrusion provided on the conventional new product sensing mechanism protrude outward from a side surface of the developer cartridge. Consequently, if the user touches the contact protrusion or if the contact protrusion is contacted by other components while the developer cartridge is in transit, the contact protrusions may be shifted from their detection position. If this should occur with a new developer cartridge, the image-forming device may be unable to determine that the developer cartridge is new when the cartridge is mounted in the image-forming device. It is also conceivable that the contact protrusion could be accidentally damaged or broken as a result of an external impact when the developer cartridge is outside of the image-forming device. If a new developer cartridge with damaged contact protrusion is mounted in the image-forming device, the device may be unable to determine that the developer cartridge is new and may fail to reset the page counter.

Therefore, it is an object of the invention to provide an image-forming device capable of reducing the likelihood for damage or other problems with a new product sensing mechanism in order to improve the reliability of resetting a page counter when a new developer cartridge is mounted in the image-forming device.

In order to attain the above and other objects, the invention provides an image forming device. The image forming device includes a main body and a cartridge that is detachably mountable on the main body. The cartridge includes a casing, an image bearing member, a first cleaning roller, a second cleaning roller, a first contact portion, a second contact portion, and a state changing unit. The image bearing member is rotatably supported in the casing. The first cleaning roller is rotatably supported in the casing, contacts the image bearing member, and is configured to clean a surface of the image bearing member by voltage difference between the image bearing member and the first cleaning member. The second cleaning roller is rotatably supported in the casing, is configured to contact the first cleaning member, and is configured to clean a surface of the first cleaning member by voltage difference between the first cleaning roller and the second cleaning roller. The first contact portion is electrically connected to the first cleaning roller, and includes a first exposure part that is exposed outside of the casing. The second contact portion is electrically connected to the second cleaning roller, and includes a second exposure part that is exposed outside of the casing. The state changing unit is configured to irreversibly change an electrically disconnected state between the first cleaning roller and the second cleaning roller into an electrically connected state between the first cleaning roller and the second cleaning roller. The image forming device further includes a voltage applying unit, a drive unit, a current detecting unit, a storing unit, and a resetting unit. The voltage applying unit is configured to apply voltage to the first cleaning roller via the first contact portion and apply voltage to the second cleaning roller via the second contact portion such that the voltage difference between the first cleaning roller and the second cleaning roller is generated. The drive unit that is configured to rotate the image bearing member. The current detecting unit is configured to detect current generated by the voltage applying unit before and after the image bearing member rotates. The storing unit is configured to store a cumulative value that increases when the image bearing member is used. The resetting unit is configured to reset the cumulative value when the current detecting unit does not detect current before the image bearing member rotates and detects current after the image bearing member rotates.

According to another aspect, the invention provides an image forming device. The image forming device includes a main body and a cartridge. The cartridge is detachably mountable on the main body. The cartridge includes a casing, an image bearing member, a first cleaning roller, a second cleaning roller, a first contact portion, a second contact portion, and a state changing unit. The image bearing member is rotatably supported in the casing. The first cleaning roller is rotatably supported in the casing, contacts the image bearing member, and is configured to clean a surface of the image bearing member by voltage difference between the image bearing member and the first cleaning member, the first cleaning roller including a first shaft portion. The second cleaning roller is rotatably supported in the casing, is configured to contact the first cleaning member, and is configured to clean a surface of the first cleaning member by voltage difference between the first cleaning roller and the second cleaning roller, the second cleaning roller including a second shaft portion. The first contact portion is electrically connected to the first shaft portion, and includes a first exposure part that is exposed outside of the casing. The second contact portion is electrically connected to the second shaft portion, and includes a second exposure part that is exposed outside of the casing. The state changing unit is configured to irreversibly change an electrically disconnected state between one of the first shaft portion and the second shaft portion and corresponding one of the first contact portion and the second contact portion into an electrically connected state between the one of the first shaft portion and the second shaft portion and the corresponding one of the first contact portion and the second contact portion. The image forming device further includes a voltage applying unit, a drive unit, a current detecting unit, a storing unit, and resetting unit. The voltage applying unit is configured to apply voltage to the first cleaning roller via the first contact portion and apply voltage to the second cleaning roller via the second contact portion such that the voltage difference between the first cleaning roller and the second cleaning roller is generated. The drive unit is configured to rotate the image bearing member. The current detecting unit is configured to detect current generated by the voltage applying unit before and after the image bearing member rotates. The storing unit is configured to store a cumulative value that increases when the image bearing member is used. The resetting unit is configured to reset the cumulative value when the current detecting unit does not detect current before the image bearing member rotates and detects current after the image bearing member rotates.

According to still another aspect, the invention provides an image forming device. The image forming device includes a main body a cartridge. The cartridge is detachably mountable on the main body. The cartridge includes a casing, an image bearing member, a first cleaning roller, a second cleaning roller, a first contact portion, a second contact portion, and a state changing unit. The image bearing member is rotatably supported in the casing. The first cleaning roller is rotatably supported in the casing, contacts the image bearing member, and is configured to clean a surface of the image bearing member by voltage difference between the image bearing member and the first cleaning member. The second cleaning roller is rotatably supported in the casing, is configured to contact the first cleaning member, and is configured to clean a surface of the first cleaning member by voltage difference between the first cleaning roller and the second cleaning roller. The first contact portion is electrically connected to the first cleaning roller, and includes a first exposure part that is exposed outside of the casing. The second contact portion is electrically connected to the second cleaning roller, and includes a second exposure part that is exposed outside of the casing. The state changing unit is configured to irreversibly change an electrically disconnected state in which electrical current is not capable of flowing between the first cleaning roller and the second cleaning roller, into an electrically connected state in which the electrical current is capable of flowing between the first cleaning roller and the second cleaning roller. The image forming device further includes a voltage applying unit, a drive unit, a current detecting unit, a storing unit, and a resetting unit. The voltage applying unit is configured to apply voltage to the first cleaning roller via the first contact portion and apply voltage to the second cleaning roller via the second contact portion such that the voltage difference between the first cleaning roller and the second cleaning roller is generated. The drive unit that configured to rotate the image bearing member. The current detecting unit is configured to detect current generated by the voltage applying unit before and after the image bearing member rotates. The storing unit is configured to store a cumulative value that increases when the image bearing member is used. The resetting unit is configured to reset the cumulative value when the current detecting unit does not detect current before the image bearing member rotates and detects current after the image bearing member rotates.

BRIEF DESCRIPTION OF THE DRAWINGS

The particular features and advantages of the invention as well as other objects will become apparent from the following description taken in connection with the accompanying drawings, in which.

DETAILED DESCRIPTION

Overall Structure of a Laser Printer

Figure 1:
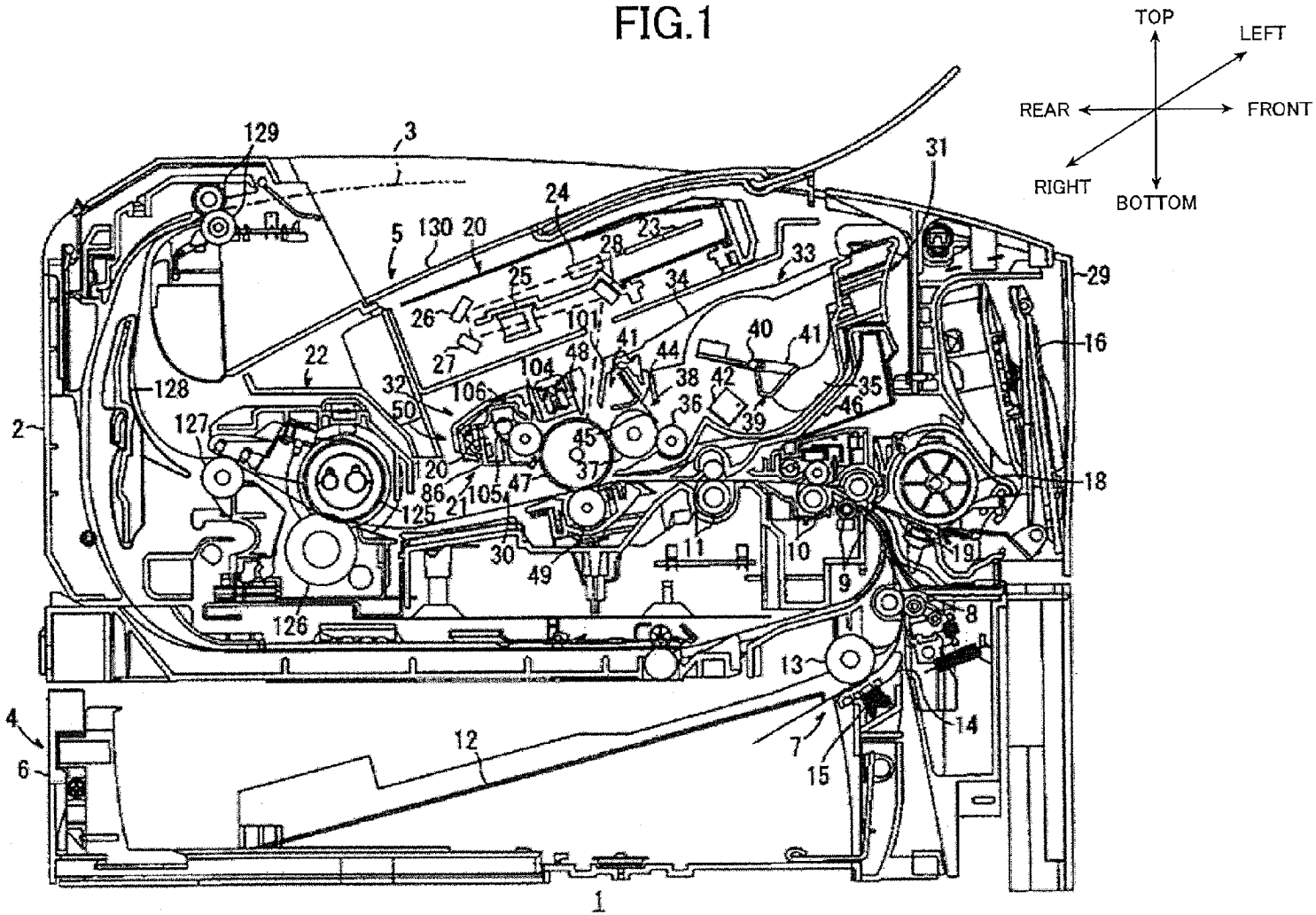
FIG. 1 is a center cross sectional view of a laser printer seeing from left according to an embodiment.
Figure 2:
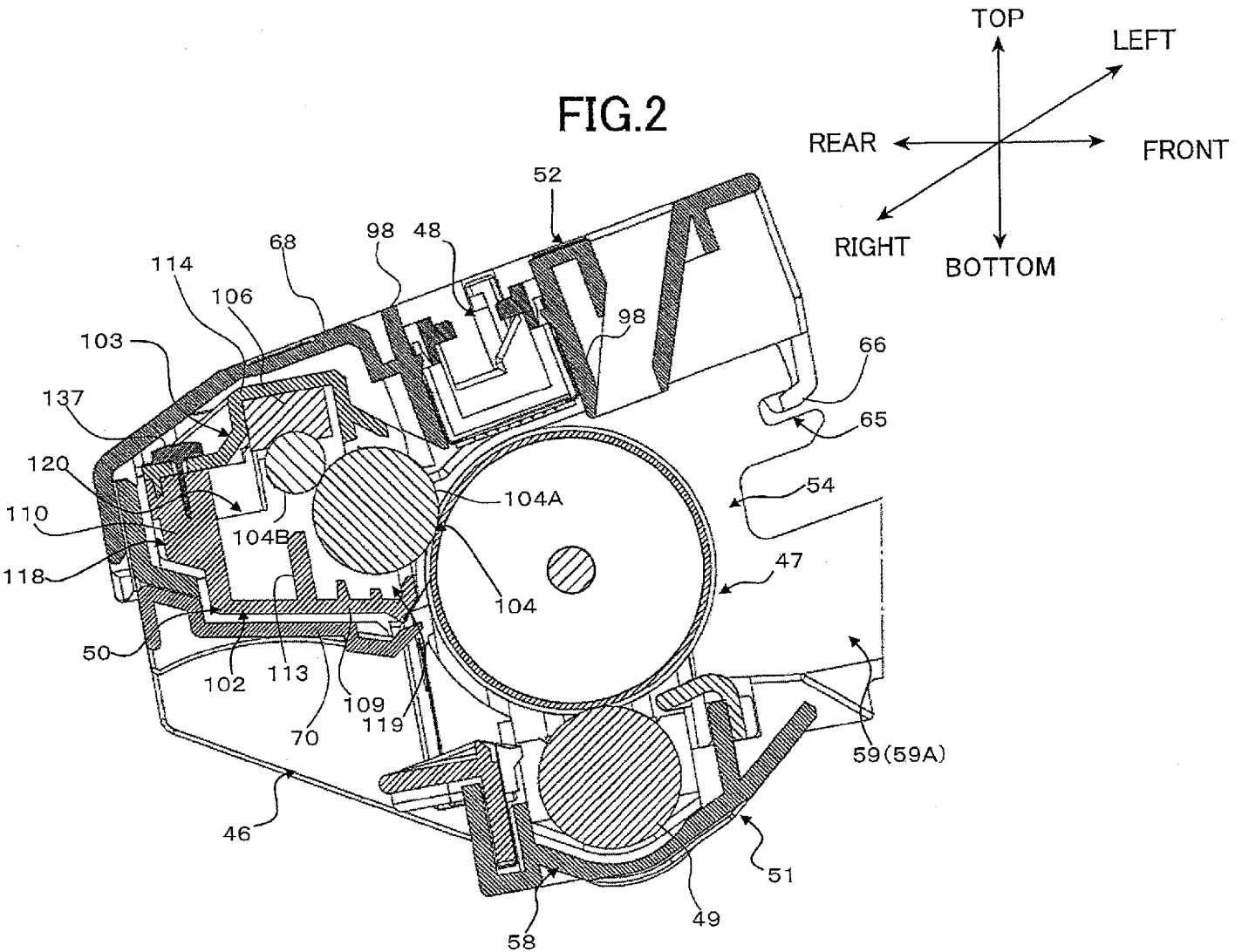
FIG. 2 is a side cross sectional view of a rear part of a drum cartridge seeing from left according to the embodiment.

The following description of the embodiments refers to directions or sides of the laser printer and its components (i.e., front/rear, forward/rearward, top/bottom, up/down, and left/right) based on the directional arrows included in the accompanying drawings. In FIGS. 1 and 2, left and right directions are orthogonal to the surface of the drawing, such that the left side corresponds to the near side of the drawing and the right side corresponds to the far side.

A laser printer 1 shown in FIG. 1 is an electrophotographic printer that forms images using a system of developing images with nonmagnetic, single-component toner. The laser printer 1 includes a main casing 2 and, within the main casing 2, a sheet-feeding unit 4 for supplying sheets of a paper 3 to be printed, and an image-forming unit 5 for forming images on the paper 3 supplied by the sheet-feeding unit 4.

Sheet-Feeding Unit

The sheet-feeding unit 4 includes a paper tray 6 that can be inserted into or removed from a lower section of the main casing 2; a sheet-feeding mechanism 7 provided on one end of the paper tray 6; pairs of conveying rollers 8, 9, and 10 disposed sequentially downstream of the sheet-feeding mechanism 7 along the conveying path of the paper 3; and a pair of registration rollers 11 disposed downstream of the conveying rollers 8, 9, and 10 along the conveying path of the paper 3.

The paper tray 6 is formed in a box-shape with an open top and serves to accommodate stacked sheets of the paper 3. The paper tray 6 can be inserted into and removed from the lower section of the main casing 2 along a horizontal direction.

The sheet-feeding mechanism 7 includes a feeding roller 13, a separating pad 14 disposed in opposition to the feeding roller 13, and a spring 15 disposed on the underside of the separating pad 14. With this construction, the separating pad 14 is pressed against the feeding roller 13 by the elastic force of the spring 15.

The feeding roller 13 rotates to feed sheets of paper 3 from the paper tray 6. As the leading edge of each sheet becomes interposed between the feeding roller 13 and the separating pad 14, the feeding roller 13 and the separating pad 14 work in association to separate multiple sheets so that only one sheet is fed at a time. Each separated sheet of paper 3 is conveyed by the conveying rollers 8, 9, and 10 to the registration rollers 11.

The registration rollers 11 first correct any skew in the sheet of paper 3, and subsequently conveys the sheet to an image-forming position (the region of contact between a photosensitive drum 47 and a transfer roller 49 described later).

Image-Forming Unit

The image-forming unit 5 includes a scanning unit 20, a process cartridge 21, and a fixing unit 22.

Scanning Unit

The scanning unit 20 is disposed in a top section of the main casing 2 and includes a laser light source (not shown), a polygon mirror 23 that is driven to rotate, lenses 24 and 25, and reflecting mirrors 26, 27, and 28.

Process Cartridge

The process cartridge 21 is detachably mounted in the main casing 2 beneath the scanning unit 20.

More specifically, the main casing 2 includes a main accommodating section 30 for accommodating the process cartridge 21, an access opening 31 that opens into the main accommodating section 30 for mounting the process cartridge 21 in and removing the process cartridge 21 from the main accommodating section 30, and a front cover 29 for covering or exposing the access opening 31.

The main accommodating section 30 is provided in the main casing 2 as a space formed beneath the scanning unit 20. The access opening 31 is formed on the front side of the main accommodating section 30.

The front cover 29 is disposed on the front side of the main casing 2 and covers portions of the front surface and top surface of the same. The front cover 29 can pivot between a closed position and an open position. The front cover 29 exposes the access opening 31 in the open position and covers the access opening 31 in the closed position.

When the front cover 29 is rotated to the open position, an operator can mount the process cartridge 21 in or remove the process cartridge 21 from the main accommodating section 30 through the access opening 31.

The process cartridge 21 includes a drum cartridge 32, and a developer cartridge 33 that is accommodated in the drum cartridge 32.

The drum cartridge 32 includes a drum frame 46 as a case, a photosensitive drum 47, a Scorotron charger 48, a transfer roller 49, and a cleaning unit 50. The photosensitive drum 47 is rotatably supported in the drum frame 46. The photosensitive drum 47 is configured of a main drum body that is electrically grounded, and a positive-charging photosensitive layer formed on the outer surface of the main drum body.

The Scorotron charger 48 is disposed above the photosensitive drum 47, opposing but separated a prescribed distance from the photosensitive drum 47. The Scorotron charger 48 is a positive-charging Scorotron type charger that includes a discharge wire for generating corona discharge. The Scorotron charger 48 functions to charge the surface of the photosensitive drum 47 with uniform positive polarity.

The transfer roller 49 is disposed beneath the photosensitive drum 47 and opposes and contacts the same. The transfer roller 49 is rotatably supported in the drum frame 46. The transfer roller 49 is configured of a metal roller shaft that is covered with a conductive rubber material.

The developer cartridge 33 includes a case 34 and, within the case 34, a toner hopper 35, a supply roller 36, a developing roller 37, and a thickness-regulating blade 38.

The toner hopper 35 is filled with a positive-charging, nonmagnetic, single-component toner. An agitator 39 is also disposed in the toner hopper 35.

The supply roller 36 is disposed rearward of the toner hopper 35, extending along the width direction (the left to right direction) of the case 34. The supply roller 36 is rotatably supported in both widthwise side walls of the case 34 and is capable of rotating in a direction opposite the rotating direction of the agitator 39.

The developing roller 37 is disposed rearward of the supply roller 36, extending along the width direction of the case 34. The developing roller 37 is also rotatably supported in both widthwise side walls of the case 34 and is capable of rotating in the same direction as the supply roller 36.

The developing roller 37 has a roller shaft that is connected to a power supply (not shown). The power supply applies a developing bias to the roller shaft during a developing operation.

The supply roller 36 and the developing roller 37 are disposed in confrontation with each other and contact each other with sufficient pressure that the supply roller 36 is somewhat compressed against the developing roller 37. The supply roller 36 and the developing roller 37 rotate such that their mutually opposing and contacting surfaces move in opposite directions.

The thickness-regulating blade 38 is disposed above the supply roller 36, extending along the width direction of the case 34. The thickness-regulating blade 38 contacts the developing roller 37 along the axial direction of the same at a position, with respect to the rotating direction of the developing roller 37, between the position that the supply roller 36 contacts the developing roller 37 and the position that the photosensitive drum 47 contacts the developing roller 37.

The rotating agitator 39 scrapes up toner within the toner hopper 35 and conveys the toner toward the supply roller 36.

Toner conveyed to the supply roller 36 is subsequently supplied to the developing roller 37 by the rotating supply roller 36. As toner is supplied from the supply roller 36 to the developing roller 37, the toner is positively tribocharged between the supply roller 36 and the developing roller 37.

As the developing roller 37 rotates, the positively charged toner carried on the surface thereof passes between the developing roller 37 and the thickness-regulating blade 38, with the thickness-regulating blade 38 regulating the thickness of the toner layer carried on the surface of the developing roller 37 to a thin layer of uniform thickness. When the toner passes between the developing roller 37 and the thickness-regulating blade 38, the toner is further tribocharged.

After the Scorotron charger 48 applies a uniform positive charge to the surface of the photosensitive drum 47, the scanning unit 20 exposes the surface of the photosensitive drum 47 by scanning a laser beam thereon. The scanned laser beam lowers the electric potential in exposed regions on the surface of the photosensitive drum 47, forming an electrostatic latent image based on prescribed image data. Next, the toner carried on the surface of the developing roller 37 rotates into and contacts the photosensitive drum 47. The toner carried by the developing roller 37 is supplied to the electrostatic latent image formed on the surface of the photosensitive drum 47, producing a visible image.

The photosensitive drum 47 and the transfer roller 49 are subsequently driven to rotate for gripping and conveying a sheet of paper 3. While the photosensitive drum 47 and the transfer roller 49 convey the sheet, the toner image carried on the surface of the photosensitive drum 47 is transferred onto the surface of the paper 3.

Fixing Unit

The fixing unit 22 is disposed on the rear side of the process cartridge 21, i.e., the downstream side of the process cartridge 21 with respect to the conveying direction of the paper 3. The fixing unit 22 includes a heating roller 125, and a pressure roller 126. The pressure roller 126 is disposed below and in opposition to the heating roller 125 and contacts the heating roller 125 with pressure.

As the sheet of paper 3 passes between the heating roller 125 and the pressure roller 126, the toner transferred onto the paper 3 is melted by heat and fixed to the paper 3. Next, discharge rollers 129 disposed downstream of the fixing unit 22 in the paper-conveying direction discharge the sheet of paper 3 that has exited the fixing unit 22 onto a discharge tray 130 formed on top of the main casing 2.

Rear-End Portion of the Drum Cartridge

Next, a portion of the drum cartridge 32 on the rear end will be described in greater detail while referring to FIG. 2.

The drum frame 46 is configured of a lower frame 51, and an upper frame 52 disposed above the lower frame 51 and mounted on the same.

The lower frame 51 is integrally provided with a drum-accommodating unit 54 for accommodating the photosensitive drum 47 and the transfer roller 49.

The drum-accommodating unit 54 is integrally provided with a transfer-roller-receiving part 58, and side plates 59 disposed one on either widthwise end of the transfer-roller-receiving part 58. The side plates 59 oppose each other in the width direction and include a right side plate 59A and a left side plate 59B (only the right side plate 59A is shown in FIG. 2). The drum-accommodating unit 54 is substantially U-shaped with an open top.

The transfer roller 49 is disposed in the transfer-roller-receiving part 58, extending in the width direction. The transfer roller 49 is rotatably supported in both side plates 59 provided on both ends of the transfer-roller-receiving part 58 and is capable of rotating in the direction opposite the rotating direction of the photosensitive drum 47.

The photosensitive drum 47 is rotatably supported between the side plates 59. The photosensitive drum 47 is disposed above and confronts the transfer roller 49.

The lower frame 51 is also provided with a bottom support plate 70 disposed to the rear of the photosensitive drum 47 and beneath the cleaning unit 50. The bottom support plate 70 supports a bottom wall 109 of the cleaning unit 50.

A lower engaging part 65 is formed in the front edge of each side plate 59 near the top thereof. Each lower engaging part 65 is substantially U-shaped, elongated in the front-to-rear direction and open on the front side. The upper portion of the lower engaging part 65 constitutes a protrusion 66.

The upper frame 52 is provided with a top plate 68 for covering the top of the drum-accommodating unit 54 formed in the lower frame 51. A pair of support plates 98 is provided in the top plate 68 midway in the front-to-rear direction thereof. The support plates 98 oppose each other at a prescribed interval in the front-to-rear direction. The support plates 98 are bent so as to extend downward from the top plate 68. The Scorotron charger 48 is disposed between the support plates 98.

The cleaning unit 50 includes two cleaning rollers 104 (a primary cleaning roller 104A and a secondary cleaning roller 104B).

Figure 3:
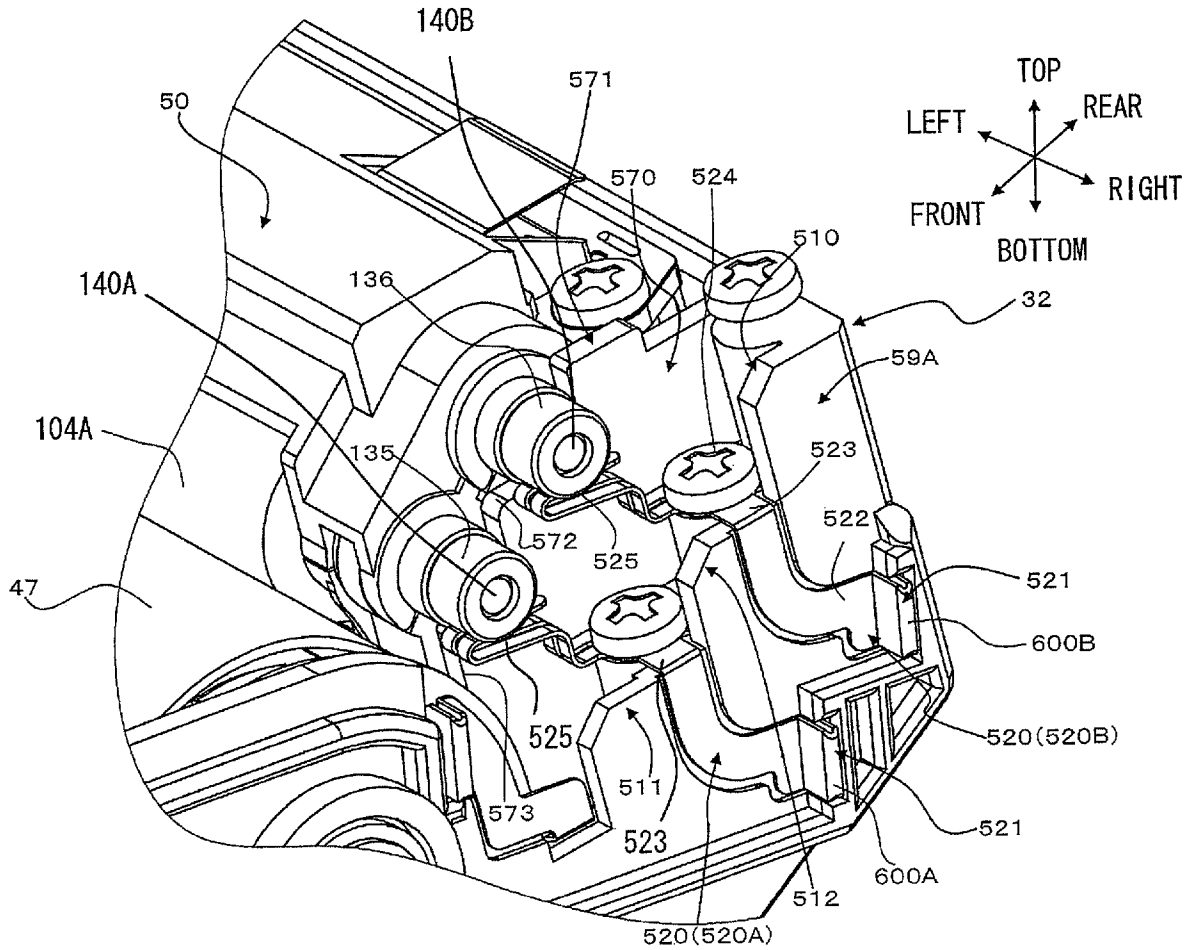
FIG. 3 is a perspective view of a rear part of the drum cartridge seeing from upper right when an upper frame is removed.

FIG. 3 shows the state of the drum cartridge 32 where the upper frame 52 is abbreviated for explanation. The rear portion of the right side plate 59A constituting the drum cartridge 32 has been cut out in step-like notches to form a stepped part 510. The stepped part 510 is formed with downward steps from the rear side toward the front side that approach the transfer roller 49 when moving toward the photosensitive drum 47. The stepped part 510 includes a first step part 511 and a second step part 512 that is located rear side of the first step part 511.

The right side plate 59A is provided with two electrodes 520 that are connected to a power supply 350 (see FIG. 5) when the process cartridge 21 is mounted in the laser printer 1. The electrodes 520 are a first electrode 520A connected to a collar member 135 (described later), and a second electrode 520B connected to a collar member 136 (described later). The first electrode 520A is positioned below the second electrode 520B.

The second electrode 520B is formed of a metal disc-shaped member. The second electrode 520B has a rectangular protruding part 521 that protrudes outward in the left to right direction, that is, a direction following the rotational axis of a pair of cleaning rollers 104. A substantially arc-shaped arcing part 522 extends upward from the protruding part 521 along the edge of the right side plate 59A. The end of the arcing part 522 opposite the protruding part 521 extends to one side of the second step part 512. A rectangular shaped fixing part 523 is provided on the end of the second electrode 520B opposite the protruding part 521. The fixing part 523 is bent inward at substantially a right angle so as to extend from the end part toward the inside of the drum cartridge 32 in the left to right direction. The fixing part 523 is fixed to the case (the drum frame 46) of the drum cartridge 32 by a screw 524. A contact surface 525 formed on the second electrode 520B extends forward from the fixing part 523 and is bent backward a plurality of times in order to contact the collar member 136. A contact point 600B is provided on the outer endface of the protruding part 521 for forming an electrical connection with the power supply 350 in the main casing 2. The first electrode 520A has a shape similar to that of the second electrode 520B and, hence, a description of the first electrode 520A will be omitted. The end of the arcing part 522 of the first electrode 520A opposite the protruding part 521 extends to one side of the first step part 511. The first electrode 520A has a contact point 600A similar to the contact point 600B of the second electrode 520B for forming an electrical connection with the power supply 350 in the main casing 2.

An inner support side wall 570 is formed farther inside the drum cartridge 32 than the first electrode 520A and the second electrode 520B and adjacent to the first electrode 520A and the second electrode 520B with respect to the axial direction of the cleaning rollers 104. The inner support side wall 570 has a supporting stepped part 571 for supporting the cleaning unit 50 when the cleaning unit 50 is mounted in the drum cartridge 32. As with the stepped part 510, the supporting stepped part 571 is formed of downward progressing steps that approach the transfer roller 49 while moving from the rear toward the photosensitive drum 47. The supporting stepped part 571 includes a first support step part 572 and a second support step part 573 respectively positioned adjacent to the second electrode 520B and first electrode 520A in the axial direction of the cleaning rollers 104.

When the upper frame 52 is mounted on the drum cartridge 32, the protruding parts 521 of the electrodes 520 remain exposed on the outside, while the arcing parts 522, the fixing parts 523, and the contact surfaces 525 are accommodated inside the drum cartridge 32.

Cleaning Unit

Figure 4:
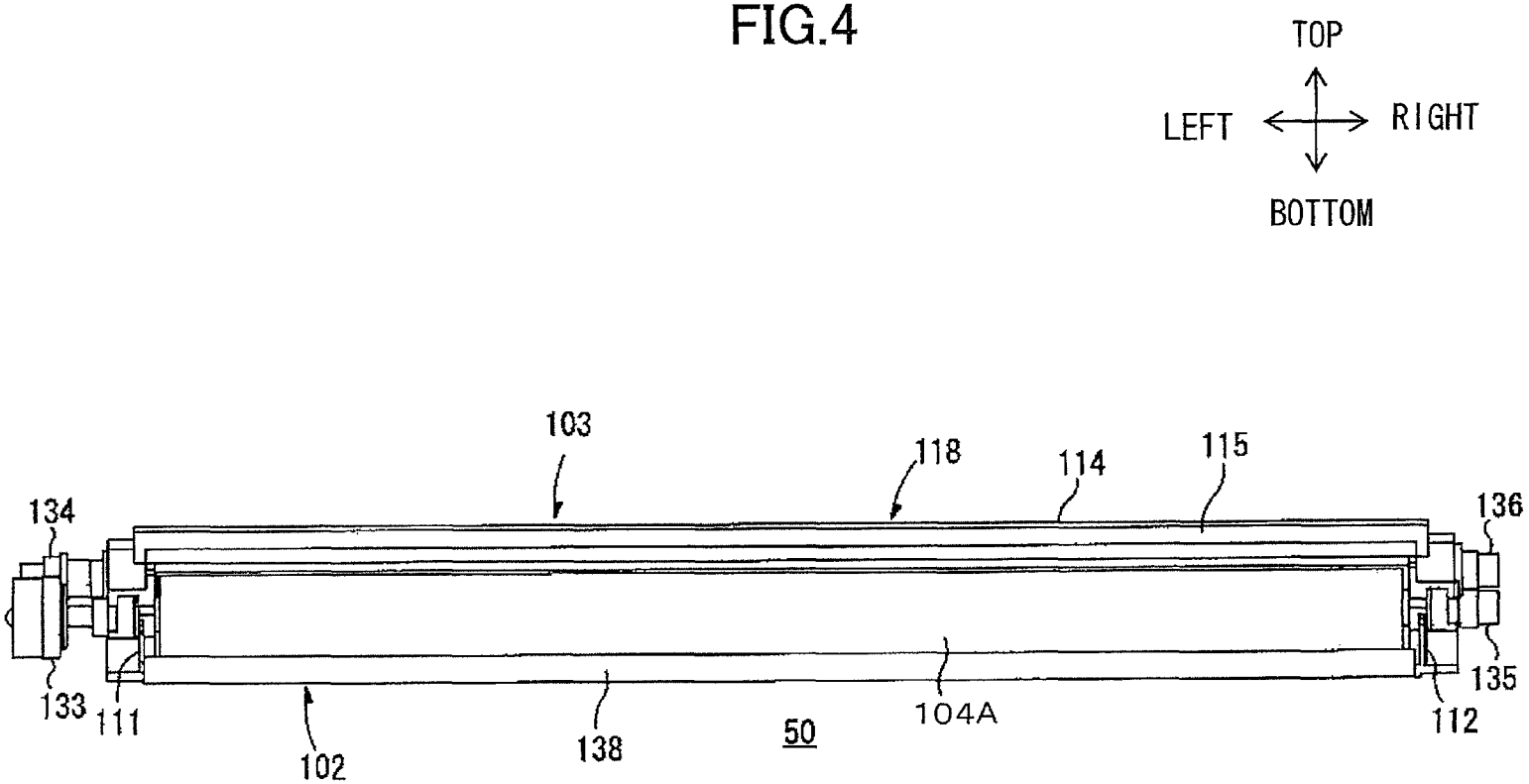
FIG. 4 is a front view of a cleaning unit.

As shown in FIGS. 2 and 4, the cleaning unit 50 is disposed on the rear end of the lower frame 51 and confronts the photosensitive drum 47. The cleaning unit 50 includes a lower frame 102, an upper frame 103, a sponge scraper 106, a paper dust storage cavity 120 disposed lower rear side of the sponge scraper 106, and the pair of cleaning rollers 104.

The lower frame 102 is integrally configured of the bottom wall 109, a rear wall 110, a left wall 111, and a right wall 112 (see FIG. 4). A partitioning wall 113 extending in the width direction (the left to right direction) is disposed in the lower frame 102 at a midway position in the front-to-rear direction.

The upper frame 103 is disposed above the lower frame 102 and is mounted so as to cover the lower frame 102. Once mounted, the upper frame 103 is fixed to the lower frame 102 by a screw 137. The upper frame 103 and the lower frame 102 form a case 118. The case 118 has an open front side confronting the photosensitive drum 47. A paper dust removal cavity 119 (FIG. 2) is formed in the case 118. The case 118 accommodates the two cleaning roller 104.

The primary cleaning roller 104A is formed of an elastic foam material, such as a silicone rubber. The primary cleaning roller 104A includes a rotational shaft 140A (FIG. 3). As shown in FIG. 2, the primary cleaning roller 104A is disposed in the paper dust removal cavity 119. The primary cleaning roller 104A is rotatably supported in the left wall 111 and the right wall 112 of the lower frame 102 so that a portion of its peripheral surface is exposed through the opening formed in the case 118 and confronts and contacts the photosensitive drum 47.

A primary cleaning roller drive gear 133 (FIG. 4) is provided on one end (left end in the embodiment) of the primary cleaning roller 104A that protrudes farther outward in the width direction than the left wall 111. The primary cleaning roller drive gear 133 transfers a drive force to the primary cleaning roller 104A from a main motor 360 described later. The drive force inputted from the primary cleaning roller drive gear 133 drives the primary cleaning roller 104A to rotate. The primary cleaning roller drive gear 133 is engaged with a photosensitive drum drive gear (not shown) provided on an end of the photosensitive drum 47. Accordingly, the rotation of the photosensitive drum 47 rotates the primary cleaning roller 104A.

As shown in FIG. 4, the collar member 135 is provided on the other end (right end in the embodiment) of the primary cleaning roller 104A that protrudes farther outward in the width direction from the right wall 112. The collar member 135 contacts the electrodes 520 provided in the drum cartridge 32 (see FIG. 3). The power supply 350 (FIG. 5) applies a primary cleaning voltage (about 800 V) to the primary cleaning roller 104A via the collar member 135.

The secondary cleaning roller 104B is configured of a metal roller. The secondary cleaning roller 104B is disposed in the paper dust removal cavity 119 on the rear side of the primary cleaning roller 104A so as to oppose and contact the primary cleaning roller 104A. The secondary cleaning roller 104B is rotatably supported by the left wall 111 and the right wall 112 of the lower frame 102. The secondary cleaning roller 104B includes a rotational shaft 140B.

A secondary cleaning roller drive gear 134 is provided on one end (left end in the embodiment) of the secondary cleaning roller 104B that protrudes farther outward in the width direction than the left wall 111. The secondary cleaning roller drive gear 134 is engaged with the primary cleaning roller drive gear 133. The secondary cleaning roller 104B is driven to rotate by a drive force inputted into the secondary cleaning roller drive gear 134.

The collar member 136 is provided on the other end (right end in the embodiment) of the secondary cleaning roller 104B that protrudes farther outward in the width direction than the right wall 112. The collar member 136 contacts the electrodes 520 provided in the drum cartridge 32 (FIG. 3). The power supply 350 (FIG. 5) applies a secondary cleaning voltage (about 900 V) to the secondary cleaning roller 104B via the collar member 136. The power supply 350 is configured to apply voltages to the cleaning rollers 104 such that the secondary cleaning voltage is larger than the primary cleaning voltage.

Figure 5:
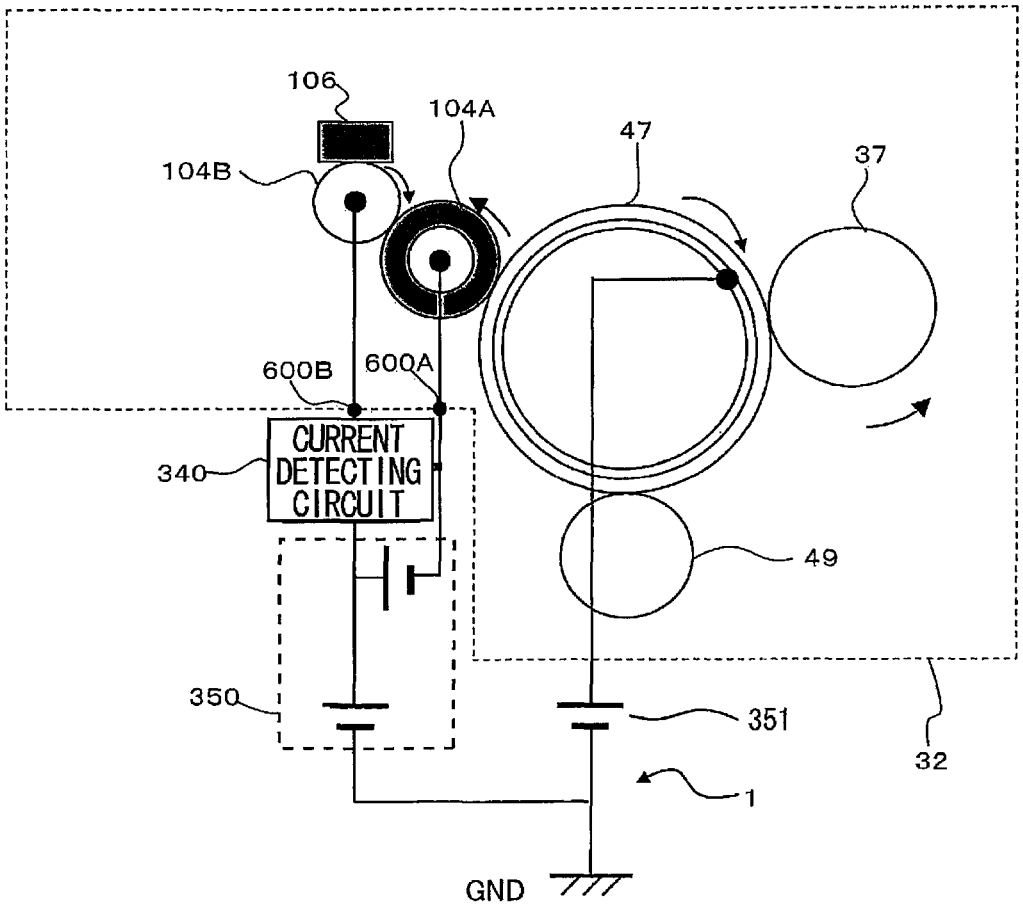
FIG. 5 is a circuit diagram illustrating a construction to apply voltage to a pair of cleaning rollers and a photosensitive drum.

FIG. 5 shows the state of the drum cartridge 32 when mounted in the laser printer 1. Here, the primary cleaning roller 104A and the secondary cleaning roller 104B are electrically connected to the power supply 350 through the contact points 600A and 600B. When the photosensitive drum 47 is rotating, the power supply 350 applies a voltage to the primary cleaning roller 104A so that the surface potential of the primary cleaning roller 104A (about 800 V) is greater than the surface potential of the photosensitive drum 47 (about 600 V or less) in order to attract paper dust from the surface of the photosensitive drum 47 to the primary cleaning roller 104A in the cleaning unit 50. Here, a power supply 351 applies voltage to the photosensitive drum 47.

The power supply 350 applies a voltage to the secondary cleaning roller 104B so that the surface potential of the secondary cleaning roller 104B (about 900 V) is greater than the surface potential of the primary cleaning roller 104A (about 800 V) in order to attract paper dust from the surface of the primary cleaning roller 104A to the surface of the secondary cleaning roller 104B.

The paper dust captured on the primary cleaning roller 104A is constantly electrically attracted to the surface of the secondary cleaning roller 104B when rotated to a position opposing the secondary cleaning roller 104B. Once captured on the secondary cleaning roller 104B, the paper dust is scraped off by the sponge scraper 106 when rotated opposite the same and is collected in the paper dust storage cavity 120. This construction allows paper dust to be collected in the cleaning unit 50 without diminishing the cleaning function of the primary cleaning roller 104A.

Hence, in the cleaning unit 50, the primary cleaning roller 104A electrically removes paper dust from the surface of the photosensitive drum 47, while the secondary cleaning roller 104B electrically attracts the paper dust that has migrated onto the surface of the primary cleaning roller 104A. Accordingly, the cleaning unit 50 can efficiently remove paper dust in parallel with the residual toner recovery of the developing roller 37 according to a cleanerless developing system, thereby improving the capacity of the laser printer 1 to remove paper dust.

A current detecting circuit 340 is electrically connected to the contact point 600B and the power supply 350.

Figure 6:
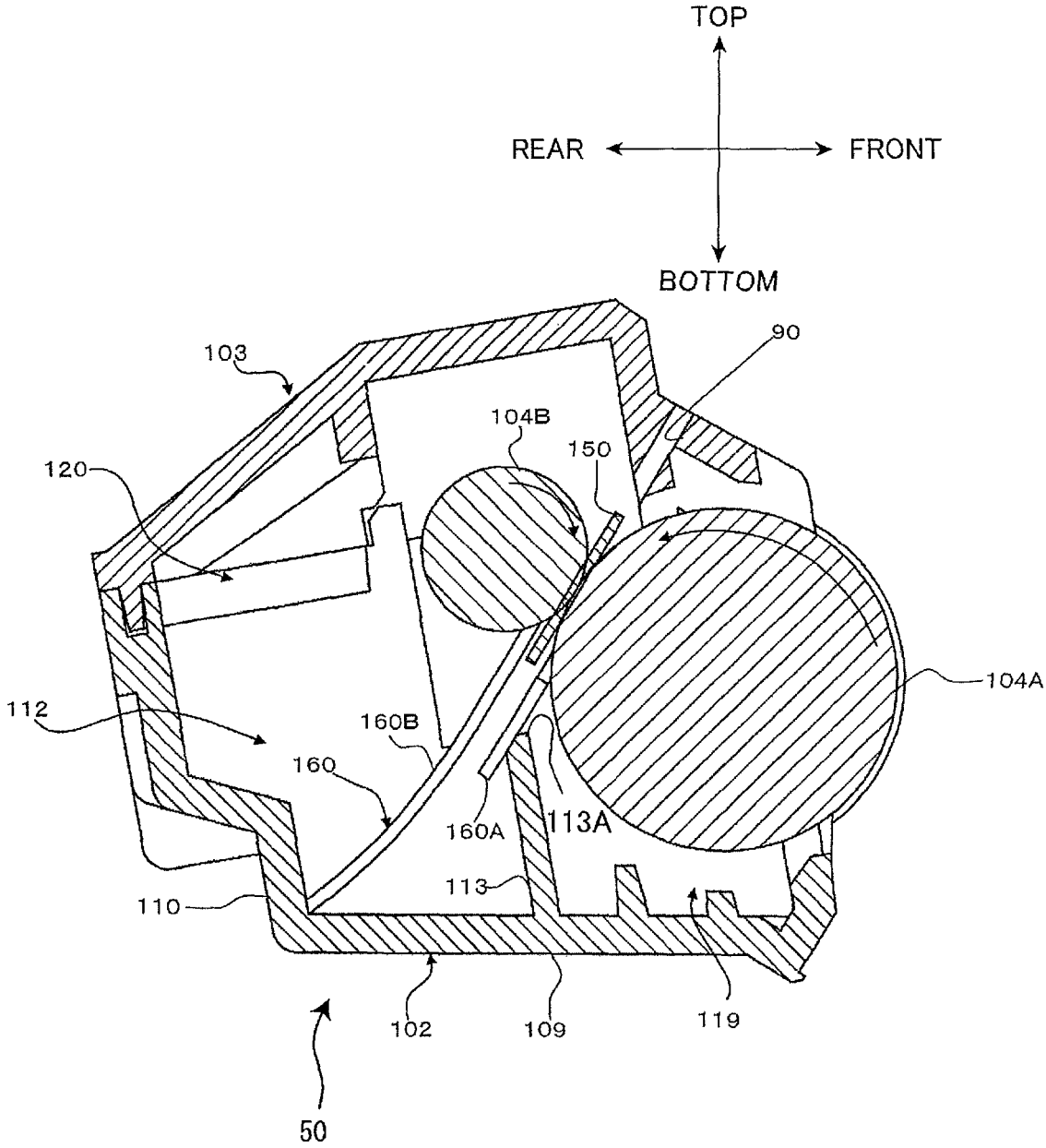
FIG. 6 is a side cross sectional view of a cleaning unit of a new drum cartridge seeing from right.

FIG. 6 is a side cross-sectional view of the cleaning unit 50. When the drum cartridge 32 is new, a rectangular PET film 150 (see FIG. 7) is interposed between the primary cleaning roller 104A and the secondary cleaning roller 104B. The volume resistance of the PET film 150 is about $10^{17}$ Ω·cm.

The PET film 150 is interposed between the primary cleaning roller 104A and the secondary cleaning roller 104B and extends in the entire regions of the surfaces of the same in the axial direction (left-to-right direction). Since the PET film 150 is an insulating material, the primary cleaning roller 104A and the secondary cleaning roller 104B are prevented from electrically contacting each other and, hence, no electric current flows therebetween.

As shown in FIG. 6, a guide part 160 is provided on the inner side of each of the left wall 111 and the right wall 112 constituting the cleaning unit 50. The guide part 160 is formed in the paper dust storage cavity 120. The guide parts 160 serve to guide the PET film 150 toward the bottom wall 109. The guide parts 160 on the left wall 111 and the right wall 112 have the same shape. Therefore, only the guide part 160 provided on the right wall 112 will be described here.

The guide part 160 is configured of a pair of plate-shaped members protruding into the cleaning unit 50 from the right wall 112. The plate-shaped members are a first guide plate 160A and a second guide plate 160B. The first guide plate 160A extends diagonally rearward and downward from a point near the nip position between the primary cleaning roller 104A and the secondary cleaning roller 104B to a point near the lower rear side of an upper edge 113A of the partitioning wall 113. The second guide plate 160B is positioned above (and rear side of) the first guide plate 160A and extends diagonally rearward and downward from a point near the nip position between the primary cleaning roller 104A and the secondary cleaning roller 104B to the connecting point between the bottom wall 109 and the rear wall 110.

A film insertion slot 90 is formed in the front side of the upper frame 103. The film insertion slot 90 is formed as a rectangular slit cut out in the upper frame 103 that extends in the left-to-right direction. The film insertion slot 90 is formed in the upper frame 103 in a direction sloping diagonally rearward and downward in order to guide the PET film 150 inserted through the film insertion slot 90 toward the nip part between the primary cleaning roller 104A and the secondary cleaning roller 104B. The PET film 150 is inserted into the cleaning unit 50 through the film insertion slot 90 and interposed between the primary cleaning roller 104A and the secondary cleaning roller 104B.

Figure 7:
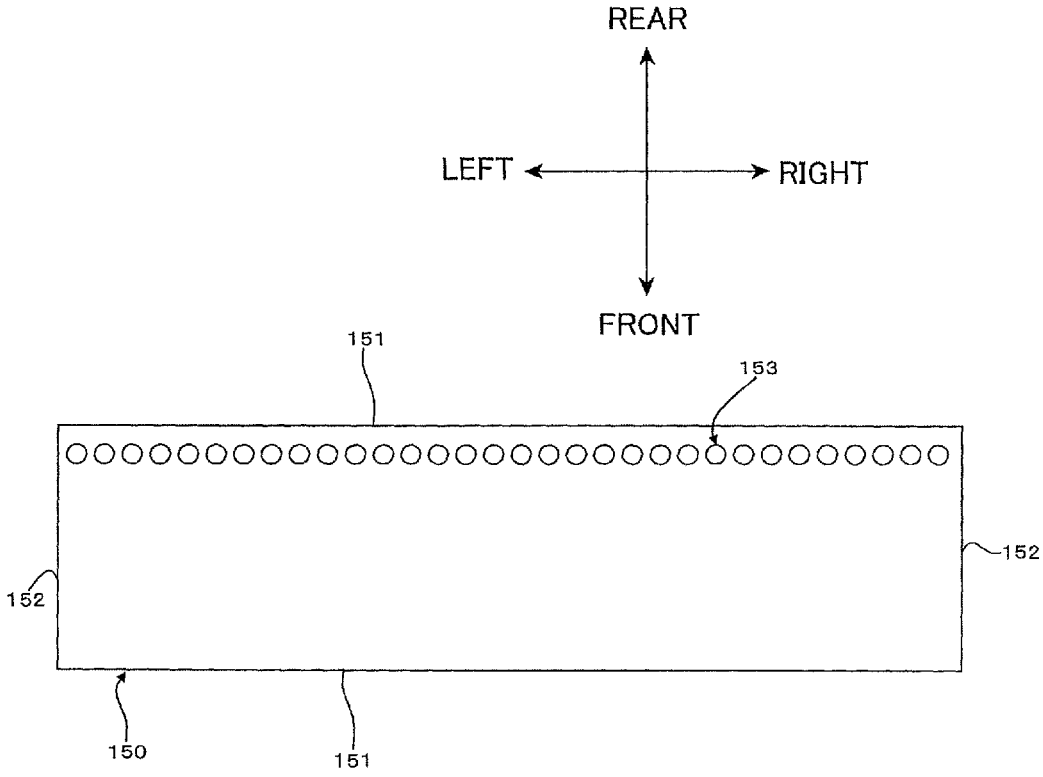
FIG. 7 is a plane view of a PET film.

As shown in FIG. 7, the PET film 150 is rectangular in shape with long sides 151 extending parallel to each other along the axial direction of the cleaning rollers 104 (left-to-right direction), and short sides 152 extending orthogonal to the long sides 151. The long sides 151 of the PET film 150 are longer than the cleaning rollers 104 in the axial direction thereof.

The short sides 152 of the PET film 150 are longer than the nip part between the primary cleaning roller 104A and the secondary cleaning roller 104B in the direction orthogonal to the axial direction of the cleaning rollers 104, that is, a tangential direction of the cleaning rollers 104 at the nip point. Specifically, the PET film 150 extends over at least one of lengths of roller portions of the cleaning rollers 104. Hence, when inserted between the primary cleaning roller 104A and the secondary cleaning roller 104B, the PET film 150 can ensure that there is no electrical contact therebetween. A plurality of openings 153 is formed in the PET film 150 along one of the long sides 151. The array of openings 153 is positioned rearward of the cleaning rollers 104 when the PET film 150 is interposed therebetween.

The cleaning rollers 104 rotate in directions indicated by the arrows in FIG. 6 when driven by a drive force from the main motor 360 described later. When the cleaning rollers 104 rotate, the PET film 150 interposed between the primary cleaning roller 104A and the secondary cleaning roller 104B is discharged into the paper dust storage cavity 120. That is, the PET film 150 is displaced from a first position interposed between the cleaning rollers 104 to a second position discharged in the paper dust storage cavity 120.

Figure 8:
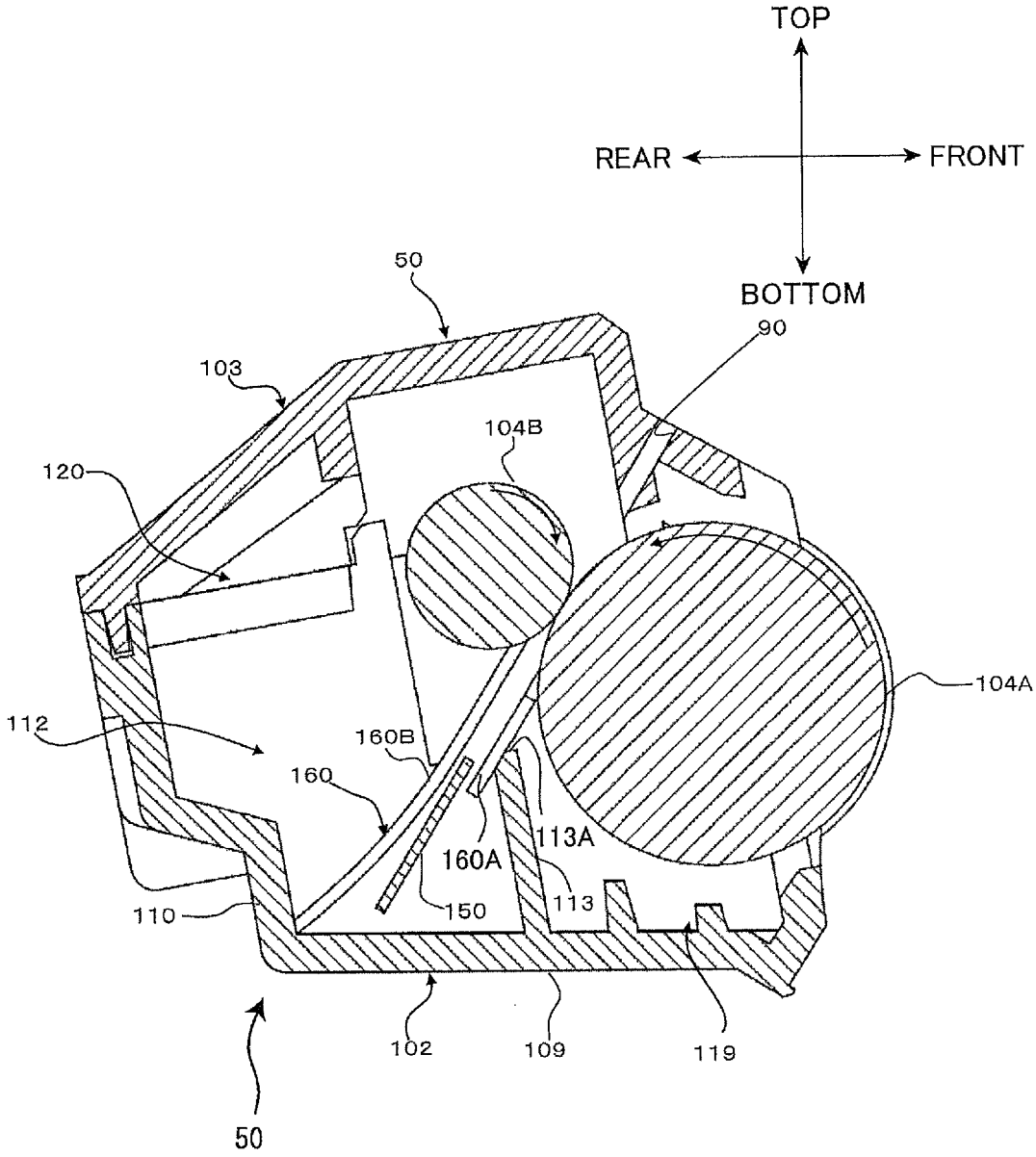
FIG. 8 is a side cross sectional view of a cleaning unit of a used drum cartridge seeing from right.

When the PET film 150 is displaced, the primary cleaning roller 104A and the secondary cleaning roller 104B come into electrical contact with each other. At this time, the short sides 152 of the PET film 150 contact the guide parts 160, and the guide parts 160 guide the PET film 150 toward the bottom wall 109 (see FIG. 8).

Control Unit

A control unit 300 is provided in the body of the laser printer 1. The control unit 300 controls the operations of various components of the laser printer 1 described above. Next, the control process of the control unit 300 will be described.

Figure 9:
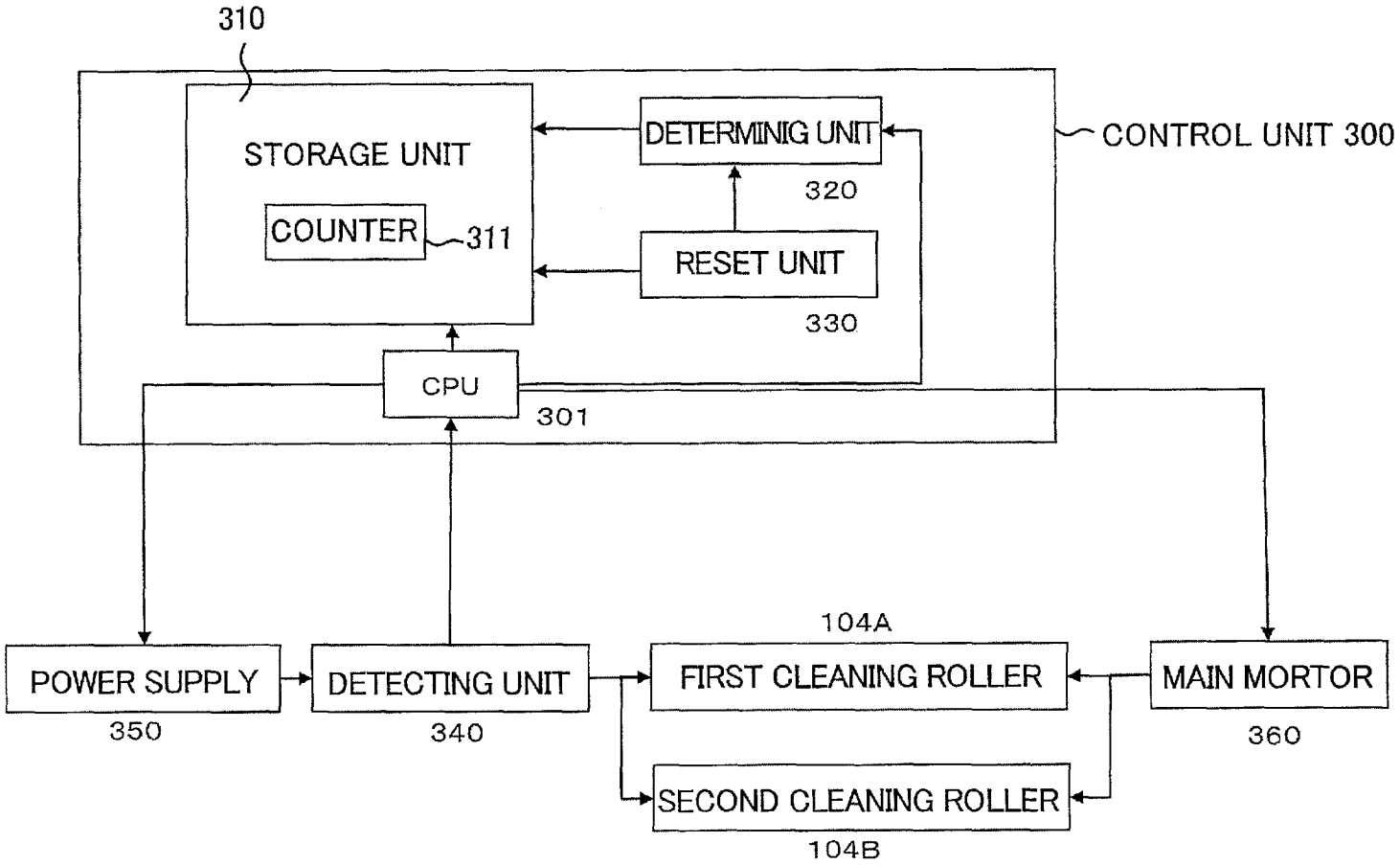
FIG. 9 is a block diagram illustrating a electrical structure of a control unit.

The functions of the control unit 300 that apply to the invention will be described next with reference to FIG. 9. As shown in FIG. 9, the control unit 300 primarily includes a CPU 301, a storage unit 310, a determining unit 320, and a reset unit 330.

The CPU 301 executes processes to control various components based on programs stored in the storage unit 310.

The storage unit 310 is primarily provided with a ROM and a RAM. The ROM stores the various programs used in the control of image-forming processes. The RAM stores the value of a counter 311 (described later), detection results of the current detecting circuit 340 (described later), and the determination results of the determining unit 320, for example.

After startup by the CPU 301, the counter 311 stores a count value indicating the cumulative rotations of the photosensitive drum 47. The CPU 301 determines the remaining service life of the photosensitive drum 47 based on the cumulative rotations of the same. When the cumulative rotations of the photosensitive drum 47 reach a predetermined number, the CPU 301 instructs the user to replace the drum cartridge 32.

The CPU 301 can calculate the number of rotations of the photosensitive drum 47 from the number of rotations of the main motor 360 described later.

The determining unit 320 determines whether a drum cartridge 32 is new or used based on the detection results of the current detecting circuit 340 described later. For the purposes of the embodiment, a drum cartridge 32 is considered to be in a "new" (unused) state when the photosensitive drum 47 in the drum cartridge 32 has not yet been driven to rotate. Consequently, a drum cartridge 32 whose photosensitive drum 47 has been rotated is considered "old" (used).

The reset unit 330 resets the value of the counter 311 based on determination results of the determining unit 320.

The power supply 350 is connected to the control unit 300, as well as the primary cleaning roller 104A and the secondary cleaning roller 104B. The power supply 350 applies cleaning voltages to the primary cleaning roller 104A and the secondary cleaning roller 104B. By generating a potential difference between the primary cleaning roller 104A and the secondary cleaning roller 104B, the power supply 350 can produce an electric current in the same.

Hence, when the primary cleaning roller 104A and secondary cleaning roller 104B are in a connected state, electricity is conducted between the cleaning rollers 104, and the power supply 350 can supply an electric current therethrough.

The current detecting circuit 340 is connected to the cleaning rollers 104 and the control unit 300. The current detecting circuit 340 functions to detect whether an electric current is flowing from the power supply 350 to the cleaning rollers 104.

The main motor 360 is connected to the cleaning rollers 104 and drives the photosensitive drum 47 and the cleaning rollers 104 to rotate in response to instructions from the control unit 300.

Control Method

Next, the method of control implemented by the control unit 300 for determining whether a drum cartridge 32 is new or used and for resetting the counter 311 will be described.

The CPU 301 starts a new product sensing process at a specific timing. The timing at which the CPU 301 detects whether the drum cartridge 32 is a new product may be the moment that the CPU 301 detects the front cover 29 being closed or the moment that the power supply of the laser printer 1 is turned on.

Upon determining that it is time to check the new/old state of the drum cartridge 32, in S01 the CPU 301 instructs the power supply 350 to apply a voltage to the primary cleaning roller 104A and the secondary cleaning roller 104B. The current detecting circuit 340 detects whether an electric current is flowing from the power supply 350 to the cleaning rollers 104 and sends the detection result to the CPU 301. The CPU 301 temporarily stores the detection result of the current detecting circuit 340 in the storage unit 310.

In S02 the CPU 301 drives the main motor 360 provided in the laser printer 1. The main motor 360 inputs a drive force into the primary cleaning roller drive gear 133, causing the primary cleaning roller 104A to rotate. The drive force is further inputted from the primary cleaning roller drive gear 133 into the secondary cleaning roller drive gear 134, causing the secondary cleaning roller 104B to rotate. The CPU 301 allows the primary cleaning roller 104A and the secondary cleaning roller 104B to rotate a prescribed time while monitoring a timer or the like (not shown).

When the drum cartridge 32 mounted in the laser printer 1 is new, the state between the primary cleaning roller 104A and the secondary cleaning roller 104B irreversibly changes from an electrically disconnected state to an electrically connected state as the cleaning rollers 104 rotate in S02. More specifically, the cleaning rollers 104 are in a disconnected state before being rotated in S02, since the PET film 150 is interposed between the cleaning rollers 104. However, as the cleaning rollers 104 are rotated in S02, the PET film 150 is conveyed by the cleaning rollers 104 and discharged into the paper dust storage cavity 120. At this time, the state of the cleaning rollers 104 changes irreversibly to an electrically connected state. The meaning of "changes irreversibly" in the embodiment signifies that, after the state between the primary cleaning roller 104A and the secondary cleaning roller 104B changes to an electrically connected state, this connected state is maintained until the drum cartridge 32 is recycled.

In S03 the CPU 301 again instructs the power supply 350 to apply a voltage across the primary cleaning roller 104A and the secondary cleaning roller 104B. The current detecting circuit 340 detects whether an electric current is flowing from the power supply 350 to the cleaning rollers 104 and sends the detection result to the CPU 301. The CPU 301 temporarily stores the detection results of the current detecting circuit 340 at this time in the storage unit 310.

Figures 10, 11:
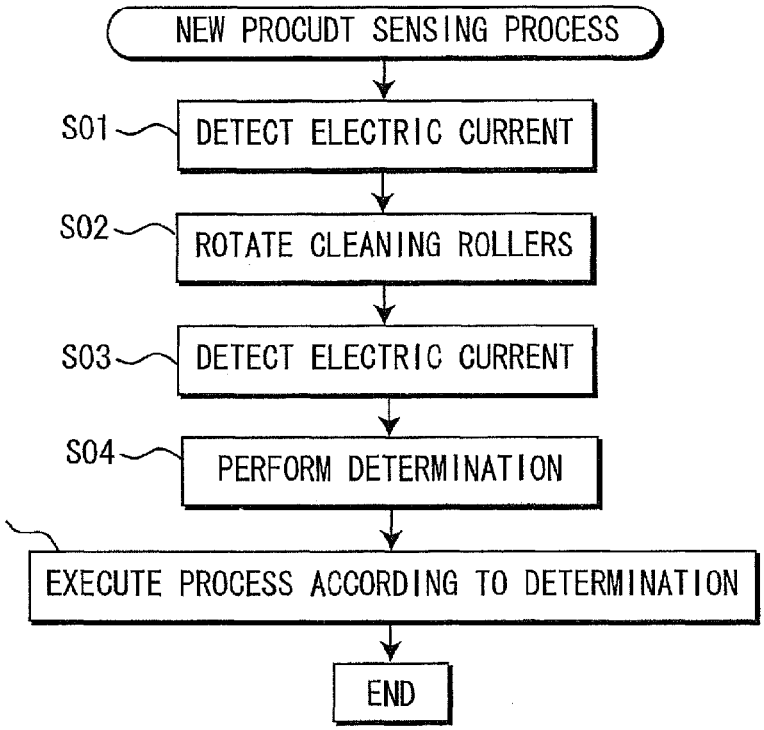
FIG. 10 is a flowchart of a new product sensing process.
FIG. 11 is a table that correlates a detection result of electrical current before and after the cleaning rollers rotate with a result of determination.

In S04 the CPU 301 controls the determining unit 320 to determine the new/old state of the drum cartridge 32. The determining unit 320 makes this determination based on the detection results of the current detecting circuit 340 stored in the storage unit 310 before and after the cleaning rollers 104 were rotated while referring to a table stored in the storage unit 310. FIG. 11 shows the table stored in the storage unit 310. The CPU 301 temporarily stores the determination results of the determining unit 320 in the storage unit 310.

In S05 the CPU 301 executes a predetermined process based on the results of the determination process in S04. Next, the determination process in S04 and the process of the control unit 300 based on the results of this determination process will be described in greater detail with reference to the table in FIG. 11.

As shown in FIG. 11, in the table, the detection results of the current detecting circuit 340 are correlated to information for determinations. That is, a State 1 indicates that the current detecting circuit 340 detected electric current both before and after the cleaning rollers 104 were rotated. In this case, it is likely that the cleaning rollers 104 were previously rotated, discharging the PET film 150 into the cleaning unit 50. Hence, in S04 the determining unit 320 determines that the drum cartridge 32 is old (used) since the photosensitive drum 47 has already been rotated. Subsequently, the CPU 301 ends the process in FIG. 10 and begins an image-forming process or enters a print-ready state.

In a State 2 shown in FIG. 11, the current detecting circuit 340 detected a current before rotating the cleaning rollers 104 but not after. This state is uncommon and is likely the result of a malfunction occurring in the laser printer 1 or the process cartridge 21. Accordingly, in S04 the determining unit 320 determines that an error has occurred, and the CPU 301 notifies the user of the error through a notification unit (not shown).

State 3 in FIG. 11 indicates that the current detecting circuit 340 detected an electric current after rotating the cleaning rollers 104 but not before. In this case, the PET film 150 was interposed between the cleaning rollers 104 before the cleaning rollers 104 were rotated and, therefore, the primary cleaning roller 104A and the secondary cleaning roller 104B were electrically disconnected prior to rotation. When the cleaning rollers 104 were rotated, the PET film 150 was discharged from the cleaning rollers 104, changing the state of the cleaning rollers 104 to an electrically connected state. Hence, the determining unit 320 determines that the drum cartridge 32 is a new product. Subsequently, the reset unit 330 resets the value stored in the counter 311, and the CPU 301 ends the process of FIG. 10 and begins an image-forming process or enters a print-ready state.

State 4 in FIG. 11 indicates that the current detecting circuit 340 did not detect an electric current prior to or after rotating the 104s. As with State 2, State 4 does not normally occur. Therefore, the determining unit 320 determines that an error has occurred and notifies the user of this error through a notification unit or the like (not shown).

As described above, the cleaning unit 50 is accommodated in the rear portion of the drum frame 46. Specifically, the cleaning unit 50 is enclosed by the upper frame 52, the side plates 59, and the bottom support plate 70 of the drum cartridge 32.

Next, the current detecting circuit 340 detects whether an electric current is being supplied to the cleaning rollers 104. The determining unit 320 then determines whether the drum cartridge 32 is new or old based on the detection results of the current detecting circuit 340. If the determining unit 320 determines that the drum cartridge 32 is new, the reset unit 330 resets the value of the counter 311 based on this determination. Accordingly, the reset unit 330 is configured to reset the value of the counter 311 based on the connected state between the cleaning rollers 104. That is, the reset unit 330 can reset the counter 311 based on a change in state within the drum cartridge 32.

Thus, the new product sensing mechanism of the invention avoids the change in state that can occur in a case where a sensing mechanism is disposed on the outside of the drum cartridge 32, and the user inadvertently damages the new product (conceivable) sensing mechanism or changes the state of the conceivable sensing mechanism by touching the same. Hence, the reset unit 330 can more reliably reset the value of the counter 311 when the drum cartridge 32 is mounted in the laser printer 1.

The laser printer 1 according to the embodiment can also maintain the cleaning rollers 104 in an electrically disconnected state by employing the PET film 150 interposed between the primary cleaning roller 104A and the secondary cleaning roller 104B. Hence, by using a simple construction of the drum cartridge 32, the laser printer 1 can detect when a drum cartridge 32 is new.

In the drum cartridge 32 of the embodiment, the primary cleaning roller 104A and the secondary cleaning roller 104B are accommodated in the case 118. Hence, the PET film 150 is also reliably accommodated in the case 118, thereby preventing contamination within the laser printer 1.

A linear array of openings 153 is formed in the PET film 150 along one long edge thereof. Hence, even when the PET film 150 is permanently discharged into the paper dust storage cavity 120, dividing the internal space of the paper dust storage cavity 120 into two compartments, the openings 153 formed in the PET film 150 allow a sufficient amount of foreign matter to pass therethrough so that foreign matter can be collected in both compartments of the internal space. Since the short sides 152 of the PET film 150 can be increased in length with this construction, the PET film 150 can reliably maintain an electrically disconnected state between the cleaning rollers 104.

The guide parts 160 are formed one each on the left wall 111 and right wall 112 inside the case 118. These guide parts 160 reliably guide the PET film 150 being discharged from the cleaning rollers 104 toward the bottom wall 109 in the paper dust storage cavity 120. Accordingly, the PET film 150 does not contact the cleaning rollers 104 after being discharged therefrom and, hence, does not interfere with the cleaning operation for the photosensitive drum 47.

Second Embodiment

Figure 12:
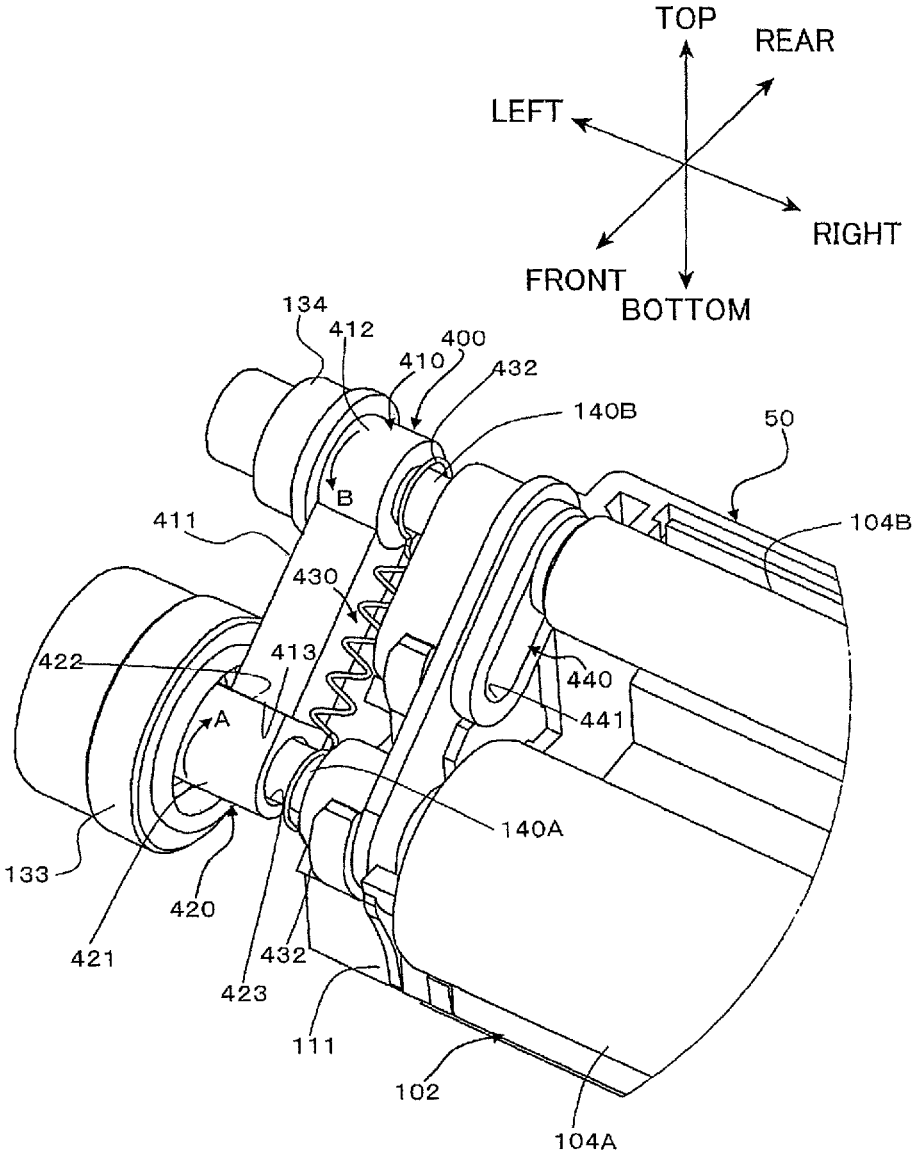
FIG. 12 is a perspective view of a left part of a cleaning unit in a new drum cartridge seeing from upper right according to a second embodiment.

Next, a second embodiment of the invention will be described while referring to the accompanying drawings. In FIG. 12, the upper frame 103 is abbreviated from the cleaning unit 50 for the explanation. Components having a similar structure to those described in the first embodiment are designated with the same reference numerals to avoid duplicating description.

As shown in FIG. 12, a contacting/separating mechanism 400 is disposed on an axial end of the cleaning rollers 104 for separating the same. When the cleaning rollers 104 are in a separated state, the secondary cleaning roller 104B is positioned diagonally above and rearward of the primary cleaning roller 104A and separated a prescribed distance therefrom.

The contacting/separating mechanism 400 primarily includes a first separating member 410, a second separating member 420, and a spring member 430.

The first separating member 410 has a spacer 411, and a cylindrical part 412. The spacer 411 has a substantially square pillar shape and is elongated in the diagonally above and rearward direction, that is, the direction in which the primary cleaning roller 104A and the secondary cleaning roller 104B are separated. One end of the spacer 411 is connected to and formed integrally with the cylindrical part 412. A flat contact surface 413 is formed on the end of the spacer 411 opposite the end on which the cylindrical part 412 is formed. The flat contact surface 413 contacts a flat surface 422 of the second separating member 420 described later for separating the primary cleaning roller 104A and the secondary cleaning roller 104B.

The axis of the cylindrical part 412 extends along the axial direction of the secondary cleaning roller 104B. The secondary cleaning roller 104B has a rotational shaft 140B, one end of which is inserted into the cylindrical part 412. That is, the cylindrical part 412 is mounted on the rotational shaft 140B so as to be freely rotatable. The cylindrical part 412 is disposed between the left wall 111 of the cleaning unit 50 and the secondary cleaning roller drive gear 134 along the rotational axis of the secondary cleaning roller 104B. The rotational shaft 140B is connected to the secondary cleaning roller drive gear 134.

The second separating member 420 extends along the axial direction of the primary cleaning roller 104A. The second separating member 420 is a block-like member that appears substantially D-shaped in left or right views. The outer peripheral surface of the second separating member 420 is configured of a curved surface 421, and the flat surface 422. The second separating member 420 also has an insertion hole 423 formed therethrough. A rotational shaft 140A of the primary cleaning roller 104A is inserted into the insertion hole 423. The primary cleaning roller drive gear 133 is connected to the rotational shaft 140A. The second separating member 420 is fixed relative to the rotational shaft 140A between the left wall 111 and the primary cleaning roller drive gear 133 so as to rotate together with the rotation of the rotational shaft 140A. When the primary cleaning roller 104A and the secondary cleaning roller 104B are in the separated state, the second separating member 420 is fixed to the rotational shaft 140A with the flat surface 422 facing the cylindrical part 412. In this separated state, the flat surface 422 of the second separating member 420 is in contact with the flat contact surface 413 of the first separating member 410.

The spring member 430 is disposed between the left wall 111 and the first separating member 410 and between the left wall 111 and the second separating member 420 with respect to the axial direction of the cleaning rollers 104. The spring member 430 is configured of a helical spring 431, and ring members 432 disposed one on either end of the helical spring 431. The ring members 432 are provided for inserting the rotational shafts 140A and 140B.

A bearing part 440 is formed on the left wall 111 for receiving the rotational shaft 140B. An elongated hole 441 is formed in the bearing part 440, extending in the diagonally above and rearward direction, that is, the direction that the primary cleaning roller 104A and the secondary cleaning roller 104B are moved to separate from and contact each other.

With the contacting/separating mechanism 400 having this construction, the spring member 430 applies a force to the secondary cleaning roller 104B acting in a direction toward the primary cleaning roller 104A. However, the contact between the flat contact surface 413 of the spacer 411 and the flat surface 422 of the second separating member 420 maintain the cleaning rollers 104 in a separated state. The elastic force of the spring member 430 also urges the flat contact surface 413 of the spacer 411 against the flat surface 422 of the second separating member 420, thereby maintaining the flat contact surface 413 and the flat surface 422 in contact with each other. In this separated state, the cleaning rollers 104 are also in an electrically disconnected state.

When the main motor 360 drives the photosensitive drum 47 to rotate while the cleaning rollers 104 are in this separated state, the drive force generated by the main motor 360 is applied to the primary cleaning roller drive gear 133, causing the primary cleaning roller 104A to rotate. Since the second separating member 420 is fixed to the rotational shaft 140A, the second separating member 420 rotates together with the primary cleaning roller 104A in the same rotational direction. When the second separating member 420 rotates, the flat contact surface 413 of the spacer 411 receives a force from the flat surface 422 of the second separating member 420 to rotate about the rotational shaft 140B in a direction opposite the rotating direction of the second separating member 420. As shown in FIG. 12, the first separating member 410 is rotated in the direction B by a rotation of the second separating member 420 in the direction A. As a result, the flat contact surface 413 separates from the flat surface 422 as the first separating member 410 rotates about the rotational shaft 140B in a direction opposite the rotating direction of the second separating member 420.

At the same time contact is eliminated between the flat surface 422 and flat contact surface 413, the force of the spring member 430 begins to move the secondary cleaning roller 104B toward the primary cleaning roller 104A, with the rotational shaft 140B guided along the elongated hole 441 formed in the bearing part 440. While the rotational shaft 140B slides along the elongated hole 441, the secondary cleaning roller 104B comes into contact with the primary cleaning roller 104A. At this time, the cleaning rollers 104 are in the contact state shown in FIG. 13.

Figure 13:
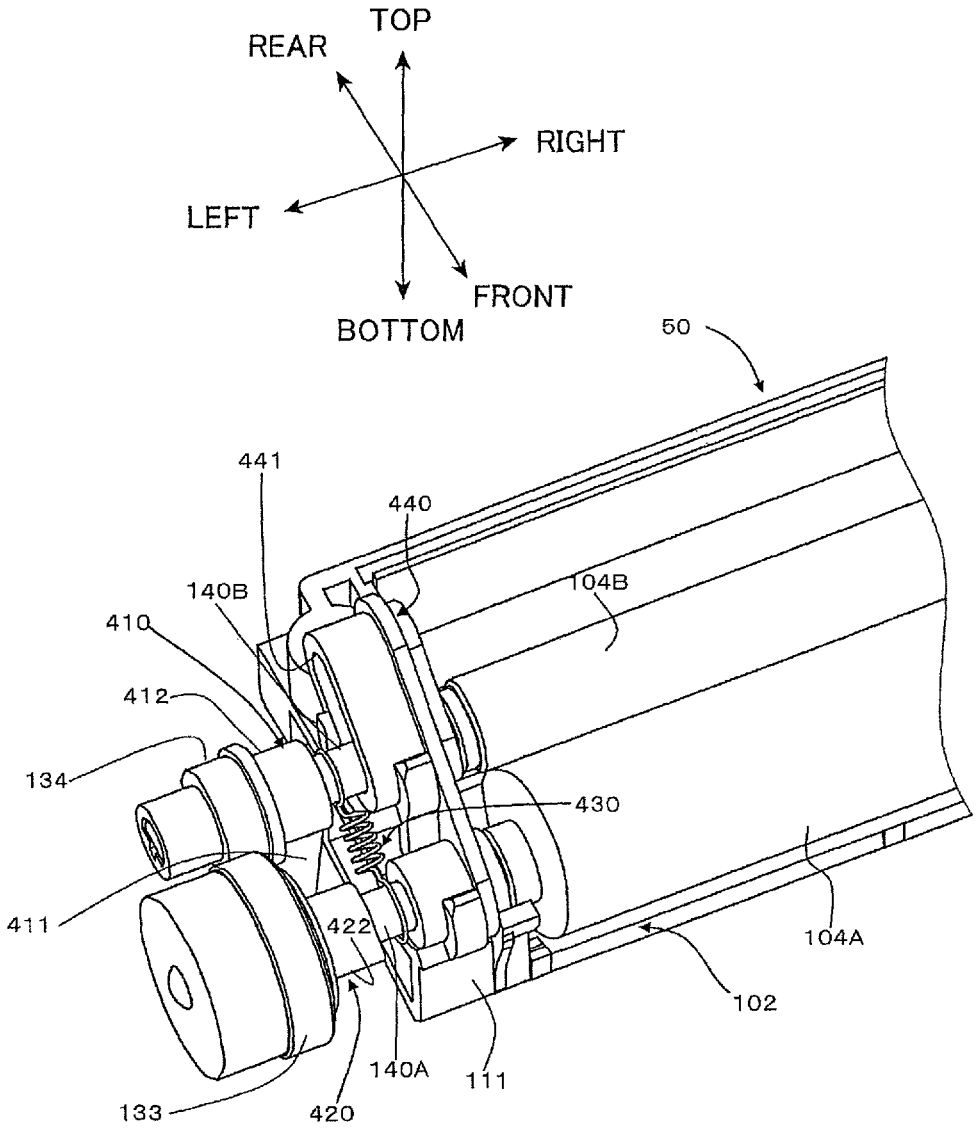
FIG. 13 is a perspective view of the cleaning unit in a used drum cartridge seeing from upper left according to the second embodiment.

As shown in FIG. 13, the first separating member 410 is only supported on the rotational shaft 140B after the second separating member 420 has been rotated, with the flat contact surface 413 of the spacer 411 facing downward. When the cleaning rollers 104 are in contact, the primary cleaning roller 104A and the secondary cleaning roller 104B are in an electrically connected state. Hence, by applying a voltage to the cleaning rollers 104, the power supply 350 can supply an electric current therethrough.

In the second embodiment described above, the cleaning unit 50 and the contacting/separating mechanism 400 are accommodated in the rear section of the drum frame 46. More specifically, the cleaning unit 50 and the contacting/separating mechanism 400 are enclosed by the upper frame 52, the side plates 59, and the bottom support plate 70 of the drum cartridge 32.

By providing the contacting/separating mechanism 400 between the cleaning rollers 104 for separating the cleaning rollers 104 and bringing the cleaning rollers 104 into contact with each other, the contacting/separating mechanism 400 can change the state of the cleaning rollers 104 between an electrically disconnected state and an electrically connected state. In this way, the contacting/separating mechanism 400 can reliably maintain the primary cleaning roller 104A and the secondary cleaning roller 104B in an electrically disconnected state. As a result, the cleaning rollers 104 can be reliably switched from an electrically disconnected state to an electrically connected state, thereby improving the accuracy in determining the newness of a drum cartridge 32. Accordingly, the reset unit 330 can reset the value of the counter 311 with greater reliability.

The spring member 430 maintains the cleaning rollers 104 in the electrically connected state. Consequently, the spring member 430 prevents a drop in the cleaning performance of the cleaning rollers 104 during an image-forming operation.

In the second embodiment, the spring member 430 urges both the primary cleaning roller 104A and the secondary cleaning roller 104B such that the primary cleaning roller 104A and the secondary cleaning roller 104B contact to each other. However, the spring member 430 may urge at least one of the primary cleaning roller 104A and the secondary cleaning roller 104B toward remaining one of the primary cleaning roller 104A and the secondary cleaning roller 104B.

Third Embodiment

Figure 14:
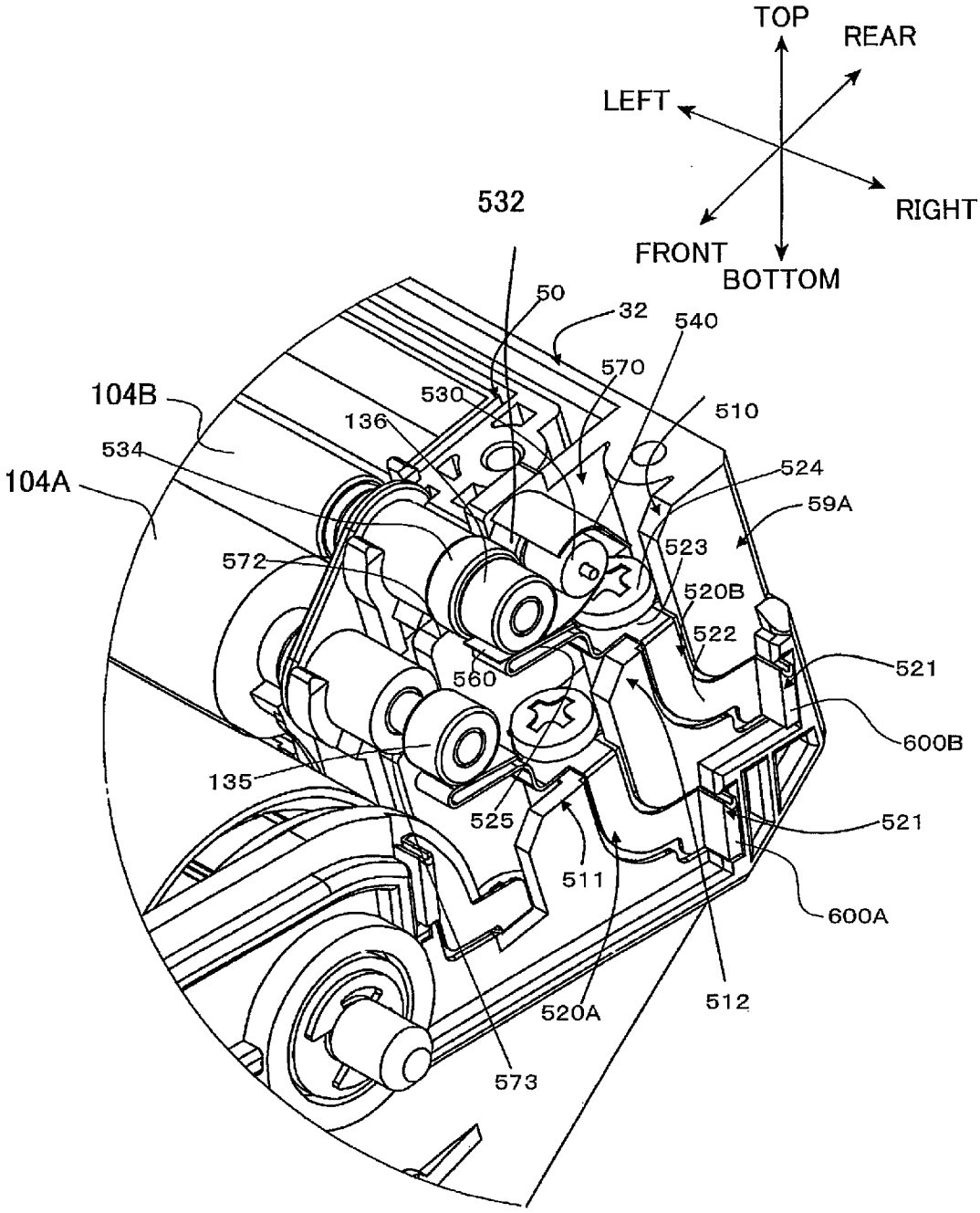
FIG. 14 is a perspective view of a new drum cartridge seeing from upper right according to a third embodiment.

Next, a third embodiment of the invention will be described while referring to the accompanying drawings. In FIG. 14, the upper frame 103 and the upper frame 52 are abbreviated for the explanation.

As shown in FIG. 14, a new drum cartridge 32 has a PET film 560 interposed between the collar member 136 and the contact surface 525 of the second electrode 520B. The PET film 560 is formed of an insulating material that prevents an electric current from being supplied from the power supply 350 to the cleaning rollers 104. In order to provide reliable insulation between the collar member 136 and the contact surface 525, the PET film 560 is formed longer than the length of the contact surface 525 with respect to the axial direction of the secondary cleaning roller 104B.

Figure 15:
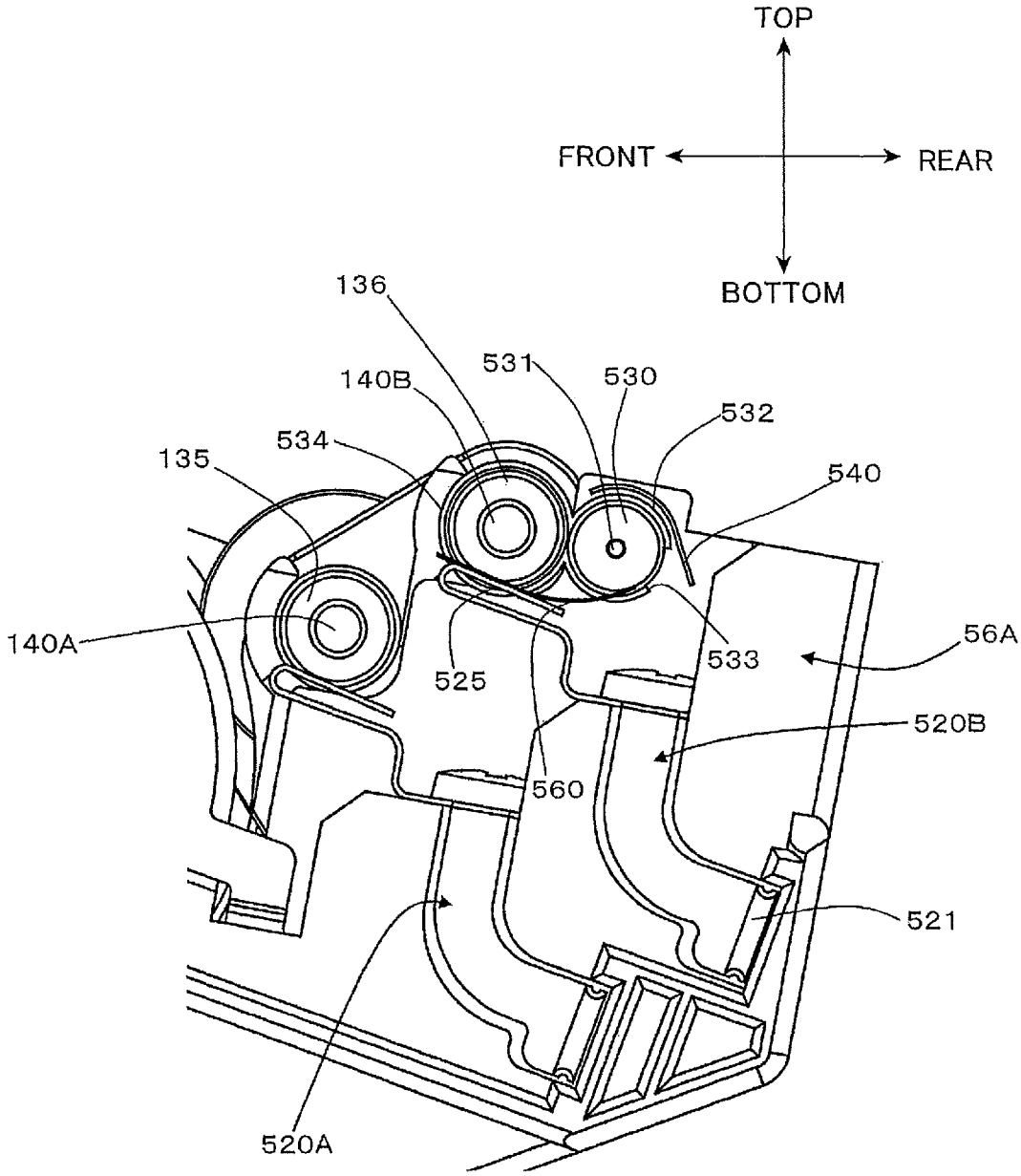
FIG. 15 is a side view of the new drum cartridge seeing from right according to the third embodiment.

As shown in FIG. 15, a take-up member 530 is provided on the inner support side wall 570 (see FIG. 14) to the rear side of the collar member 136 for extracting the PET film 560.

The take-up member 530 is cylindrical in shape and elongated in the axial direction of the cleaning rollers 104. The take-up member 530 is rotatably mounted on the inner support side wall 570 via a rotational shaft 531. A gear 532 is also provided on the rotational shaft 531 adjacent to and left side of the take-up member 530 in the axial direction of the cleaning rollers 104. The gear 532 has a toothless region 533 (see FIG. 15).

A gear 534 is provided on the rotational shaft 140B of the secondary cleaning roller 104B adjacent to and left side of the collar member 136 in the axial direction thereof. The gear 534 is fixed to the rotational shaft 140B of the secondary cleaning roller 104B. The gear 534 opposes the gear 532 and is positioned to engage with the same.

As shown in FIG. 15, the PET film 560 can be removed from between the collar member 136 and the contact surface 525 by rotating the take-up member 530. When the PET film 560 is removed, the collar member 136 and the contact surface 525 are electrically connected, forming an electrically connected state between the secondary cleaning roller 104B and the second electrode 520B. Accordingly, the power supply 350 can supply an electric current by applying a voltage to the cleaning rollers 104.

A protruding wall 540 is provided on the inner support side wall 570 for accommodating the PET film 560 when the take-up member 530 extracts the PET film 560 from between the collar member 136 and the second electrode 520B. The protruding wall 540 protrudes rightward from the inner support side wall 570 in the axial direction of the secondary cleaning roller 104B at a position above the take-up member 530. When viewed along the axial direction of the take-up member 530 (from the right side) as shown in FIG. 15, the top portion of the inner support side wall 570 follows the peripheral surface of the take-up member 530, while the lower portion on the rear side slopes downward toward the rear.

Figure 16:
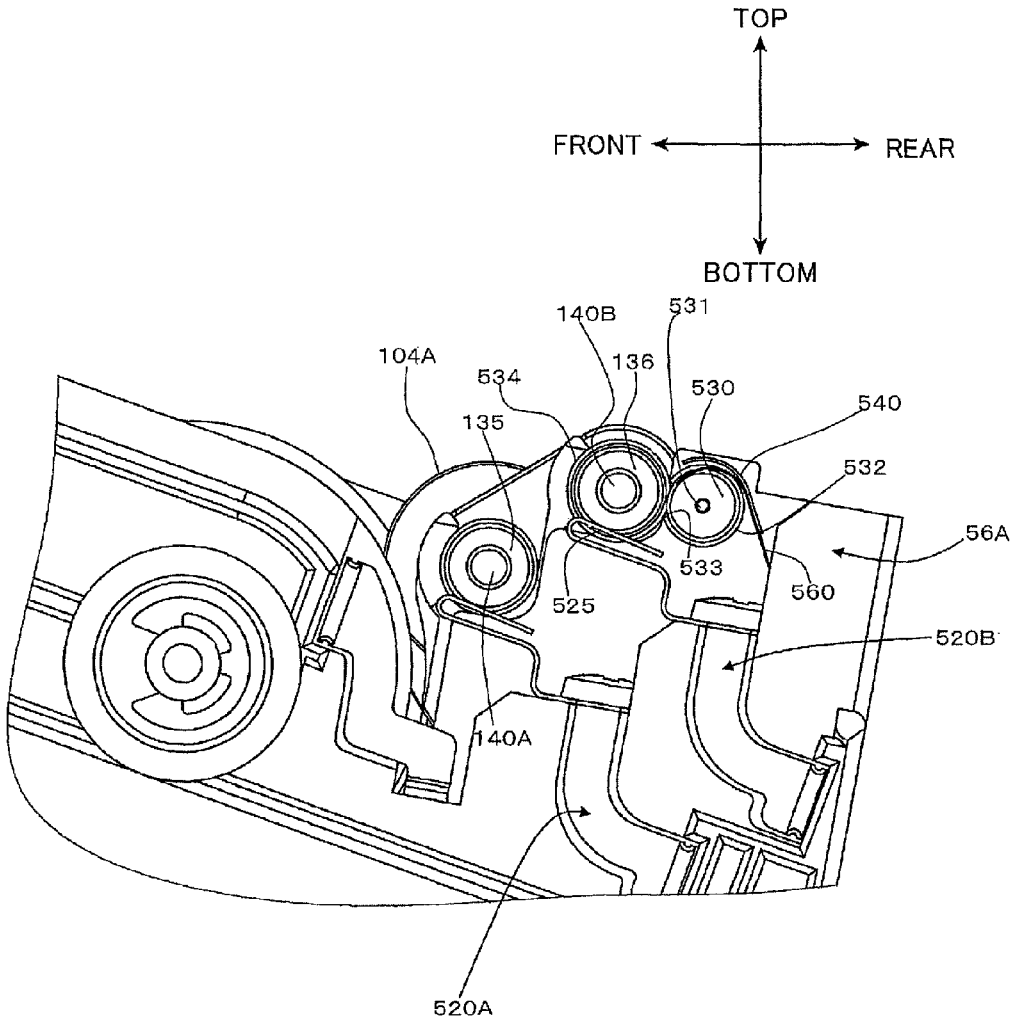
FIG. 16 is a side view of a used drum cartridge seeing from right according to the third embodiment.

As shown in FIG. 16, the gear 534 is rotated by the rotation of the secondary cleaning roller 104B and applies a drive force to the gear 532. The drive force applied to the gear 532 causes the take-up member 530 to rotate. The rotation of the take-up member 530 is halted when the toothless region 533 on the gear 532 is rotated opposite the gear 534.

As described above, the PET film 560 in a new drum cartridge 32 is interposed between the rotational shaft 140B and the second electrode 520B, maintaining the two components in an electrically disconnected state. When the cleaning rollers 104 rotate, the take-up member 530 extracts the PET film 560 from between the second electrode 520B and the rotational shaft 140B. Accordingly, an electric current is not supplied to the cleaning rollers 104 prior to rotating the same, but is supplied after rotating the same. Hence, the reset unit 330 can reset the value of the counter 311 based on detection results from the current detecting circuit 340 before and after rotating the cleaning rollers 104.

The contact surface 525, the PET film 560, and the take-up member 530 are all accommodated by the upper frame 52 inside the drum cartridge 32. Hence, this construction can prevent inadvertent changes in the state of a new product sensing mechanism that can occur in a conceivable case where a sensing mechanism is provided on the outside of the drum cartridge 32, and the user accidentally damages or touches the conceivable sensing mechanism. As a result, the reset unit 330 can reliably reset the value of the counter 311 when a new drum cartridge 32 is mounted in the laser printer 1.

The PET film 560 in a new drum cartridge 32 maintains the contact surface 525 of the second electrode 520B and the collar member 136 in an electrically disconnected state. Hence, the control unit 300 can detect when the drum cartridge 32 is a new product through a simple construction.

While the invention has been described in detail with reference to the embodiments thereof, it would be apparent to those skilled in the art that various changes and modifications may be made therein without departing from the scope of the invention.

In the embodiments described above, a PET film is used as the insulating material, but another type of insulating material may be used, such as polyethylene, polycarbonate, or polyimide.

In the second embodiment described above, the spring member 430 is used to modify the electrically connected state of the cleaning rollers 104, but a rubber member or the like may be used in place of the spring member 430. The contacting/separating mechanism is also not limited to that described in the embodiments.

In the embodiments described above, the number of rotations of the photosensitive drum 47 is used as the reference value for determining the remaining service life of the photosensitive drum 47, while the reset unit 330 resets this rotational number when a new product is mounted in the laser printer 1. However, a different reference value may be used to determine the service life of the photosensitive drum 47, such as the number of sheets discharged onto the discharge tray 130 (i.e., the number of pages printed) while the photosensitive drum 47 is used.

What is claimed is:

1. An image forming device comprising:

a main body; and a cartridge that is detachably mountable on the main body, the cartridge comprising:

a casing;

an image bearing member that is rotatably supported in the casing;

a first cleaning roller that is rotatably supported in the casing, contacts the image bearing member, and is configured to clean a surface of the image bearing member by voltage difference between the image bearing member and the first cleaning member;

a second cleaning roller that is rotatably supported in the casing, is configured to contact the first cleaning member, and is configured to clean a surface of the first cleaning member by voltage difference between the first cleaning roller and the second cleaning roller;

a first contact portion that is electrically connected to the first cleaning roller, and includes a first exposure part that is exposed outside of the casing;

a second contact portion that is electrically connected to the second cleaning roller, and includes a second exposure part that is exposed outside of the casing; and a state changing unit that is configured to irreversibly change an electrically disconnected state between the first cleaning roller and the second cleaning roller into an electrically connected state between the first cleaning roller and the second cleaning roller, the image forming device further comprising:

a voltage applying unit that is configured to apply voltage to the first cleaning roller via the first contact portion and apply voltage to the second cleaning roller via the second contact portion such that the voltage difference between the first cleaning roller and the second cleaning roller is generated;

a drive unit that is configured to rotate the image bearing member;

a current detecting unit that is configured to detect current generated by the voltage applying unit before and after the image bearing member rotates;

a storing unit that is configured to store a cumulative value that increases when the image bearing member is used; and a resetting unit that is configured to reset the cumulative value when the current detecting unit does not detect current before the image bearing member rotates and detects current after the image bearing member rotates.

2. The image forming device according to claim 1, wherein the first cleaning roller including a first shaft portion extending in an axial direction and a first roller portion coaxial with the first shaft portion, wherein the second cleaning roller including a second shaft portion extending in the axial direction and a second roller portion coaxial with the second shaft portion, wherein the state changing unit includes an insulating portion that is formed of an insulating material and that is interposed between the first cleaning roller and the second cleaning roller at an interposed position and extends over at least one of a length of the first roller portion in the axial direction and a length of the second roller portion in the axial direction such that the first cleaning roller is electrically insulated from the second cleaning roller, wherein the insulating portion is displaceable from the interposed position to a discharged position in response to a rotation of the image bearing member to bring the first cleaning roller and the second cleaning roller into electrical connection to each other.

3. The image forming device according to claim 2, wherein the cartridge further comprises an accommodating portion that accommodates the first cleaning roller and the second cleaning roller such that a part of the first cleaning roller is exposed outside and faces the image bearing member.

4. The image forming device according to claim 3, wherein the insulating portion has a rectangular shape having a long side, a short side, and an opening, the long side extending in the axial direction, the short side being shorter than the long side and extending in a short side direction, the opening being formed at an end of the insulating portion in the short side direction.

5. The image forming device according to claim 2, wherein the accommodating portion includes a support wall that rotatably supports the first cleaning roller and the second cleaning roller, wherein the support wall includes a guide portion that guides the insulating portion from the interposed position to the discharged position.

6. The image forming device according to claim 1, wherein the state changing unit includes a separation portion that separates the first cleaning member from the second cleaning member, wherein when the drive unit rotates the image bearing member, the separation portion no longer separates the first cleaning roller from the second cleaning roller and prompts the first cleaning roller and the second cleaning roller to contact each other.

7. The image forming device according to claim 6, wherein the first cleaning roller including a first shaft portion extending in an axial direction and a first roller portion coaxial with the first shaft portion, wherein the second cleaning roller including a second shaft portion extending in the axial direction and a second roller portion coaxial with the second shaft portion, wherein the separation portion includes:

an urging member that urges at least one of the first cleaning member and the second cleaning member toward remaining one of the first cleaning roller and the second cleaning roller;

a separation member that is initially disposed at a separating position between the first shaft portion and the second shaft portion such that the first cleaning roller and the second cleaning roller are separated each other, the separation member being displaceable from the separating position in response to a rotation of the first cleaning roller to bring the first cleaning roller and the second cleaning roller into contact with each other by urging force of the urging member.

8. The image forming device according to claim 2, wherein the insulating portion is a PET film.

9. The image forming device according to claim 1, wherein an electrostatic latent image is formed on the image bearing member and is developed by positively charged developer, wherein the voltage applying unit applies voltage higher than voltage applied to the image bearing member to move a paper dust from the surface of the image bearing member to the surface of the first cleaning roller, wherein the voltage applying unit applies voltage higher than the voltage applied to the first cleaning roller to move the paper dust from the surface of the first cleaning roller to the surface of the second cleaning roller.

10. An image forming device comprising:

a main body; and a cartridge that is detachably mountable on the main body, the cartridge comprising:

a casing;

an image bearing member that is rotatably supported in the casing;

a first cleaning roller that is rotatably supported in the casing, contacts the image bearing member, and is configured to clean a surface of the image bearing member by voltage difference between the image bearing member and the first cleaning member, the first cleaning roller including a first shaft portion;

a second cleaning roller that is rotatably supported in the casing, is configured to contact the first cleaning member, and is configured to clean a surface of the first cleaning member by voltage difference between the first cleaning roller and the second cleaning roller, the second cleaning roller including a second shaft portion;

a first contact portion that is electrically connected to the first shaft portion, and includes a first exposure part that is exposed outside of the casing;

a second contact portion that is electrically connected to the second shaft portion, and includes a second exposure part that is exposed outside of the casing; and a state changing unit that is configured to irreversibly change an electrically disconnected state between one of the first shaft portion and the second shaft portion and corresponding one of the first contact portion and the second contact portion into an electrically connected state between the one of the first shaft portion and the second shaft portion and the corresponding one of the first contact portion and the second contact portion, the image forming device further comprising:

a voltage applying unit that is configured to apply voltage to the first cleaning roller via the first contact portion and apply voltage to the second cleaning roller via the second contact portion such that the voltage difference between the first cleaning roller and the second cleaning roller is generated;

a drive unit that is configured to rotate the image bearing member;

a current detecting unit that is configured to detect current generated by the voltage applying unit before and after the image bearing member rotates;

a storing unit that is configured to store a cumulative value that increases when the image bearing member is used; and a resetting unit that is configured to reset the cumulative value when the current detecting unit does not detect current before the image bearing member rotates and detects current after the image bearing member rotates.

11. The image forming device according to claim 10, wherein the state changing unit includes an insulating portion that is formed of an insulating material and that is located at an interposed position between the one of the first shaft portion and the second shaft portion and the corresponding one of the first contact portion and the second contact portion, wherein the insulating portion is displaceable from the interposed position to a discharged position in response to a rotation of the image bearing member to bring the one of the first shaft portion and the second shaft portion and the corresponding one of the first contact portion into electrical connection to each other.

12. The image forming device according to claim 11, wherein the insulating portion is a PET film.

13. The image forming device according to claim 10, wherein an electrostatic latent image is formed on the image bearing member and is developed by positively charged developer, wherein the voltage applying unit applies voltage higher than voltage applied to the image bearing member to move a paper dust from the surface of the image bearing member to the surface of the first cleaning roller, wherein the voltage applying unit applies voltage higher than the voltage applied to the first cleaning roller to move the paper dust from the surface of the first cleaning roller to the surface of the second cleaning roller.

14. An image forming device comprising:

a main body; and a cartridge that is detachably mountable on the main body, the cartridge comprising:

a casing;

an image bearing member that is rotatably supported in the casing;

a first cleaning roller that is rotatably supported in the casing, contacts the image bearing member, and is configured to clean a surface of the image bearing member by voltage difference between the image bearing member and the first cleaning member;

a second cleaning roller that is rotatably supported in the casing, is configured to contact the first cleaning member, and is configured to clean a surface of the first cleaning member by voltage difference between the first cleaning roller and the second cleaning roller;

a first contact portion that is electrically connected to the first cleaning roller, and includes a first exposure part that is exposed outside of the casing;

a second contact portion that is electrically connected to the second cleaning roller, and includes a second exposure part that is exposed outside of the casing; and a state changing unit that is configured to irreversibly change an electrically disconnected state in which electrical current is not capable of flowing between the first cleaning roller and the second cleaning roller, into an electrically connected state in which the electrical current is capable of flowing between the first cleaning roller and the second cleaning roller, the image forming device further comprising:

a voltage applying unit that is configured to apply voltage to the first cleaning roller via the first contact portion and apply voltage to the second cleaning roller via the second contact portion such that the voltage difference between the first cleaning roller and the second cleaning roller is generated;

a drive unit that is configured to rotate the image bearing member;

a current detecting unit that is configured to detect current generated by the voltage applying unit before and after the image bearing member rotates;

a storing unit that is configured to store a cumulative value that increases when the image bearing member is used; and a resetting unit that is configured to reset the cumulative value when the current detecting unit does not detect current before the image bearing member rotates and detects current after the image bearing member rotates.

* * * * *